US010563450B2

(12) United States Patent
Groff

(10) Patent No.: US 10,563,450 B2
(45) Date of Patent: Feb. 18, 2020

(54) SLIDING BARN DOOR KIT

(71) Applicant: LTL Wholesale, Inc., Schuylkill Haven, PA (US)

(72) Inventor: Malcolm K. Groff, Orwigsburg, PA (US)

(73) Assignee: LTL Wholesale, Inc., Schuylkill Haven, PA (US)

( * ) Notice: Subject to any disclaimer, the term of this patent is extended or adjusted under 35 U.S.C. 154(b) by 166 days.

(21) Appl. No.: 15/647,595

(22) Filed: Jul. 12, 2017

(65) Prior Publication Data

US 2018/0023336 A1 Jan. 25, 2018

Related U.S. Application Data

(60) Provisional application No. 62/364,030, filed on Jul. 19, 2016.

(51) Int. Cl.
*E06B 3/46* (2006.01)
*E05B 65/08* (2006.01)
(Continued)

(52) U.S. Cl.
CPC ..... *E06B 3/4636* (2013.01); *E05B 65/08* (2013.01); *E05D 15/063* (2013.01);
(Continued)

(58) Field of Classification Search
CPC ..... E06B 3/4636; E06B 11/045; E06B 2003/7011; E06B 2003/7013; E05D 15/0626; E05D 15/063; E05D 15/0634
See application file for complete search history.

(56) References Cited

U.S. PATENT DOCUMENTS 694,044 A * 2/1902 Wideman ..... E05D 15/063 16/103
2,839,792 A * 6/1958 Sanders ..... E06B 3/825 428/120

(Continued)

FOREIGN PATENT DOCUMENTS

DE 3152831 A1 * 6/1983 ..... A47K 3/34
EP 2692981 A2 * 2/2014 ..... E06B 3/72
JP 2004019229 A * 1/2004 ..... E05D 15/063

OTHER PUBLICATIONS

EP 2692981 A2 English Machine Translation (Google) (Year: 2013).*
JP 2004019229 A English Machine translation (Google) (Year: 2002).*

*Primary Examiner* — Joshua J Michener
*Assistant Examiner* — Matthew J Gitlin
(74) *Attorney, Agent, or Firm* — Ryder, Mazzeo & Konieczny, LLC; Frank A. Mazzeo; Douglas J. Ryder

(57) ABSTRACT

A barn door kit includes a plurality of pieces disassembled that are packaged in a much smaller footprint than an assembled barn door. The pieces that make up the door include a plurality of frame pieces and a plurality of panels. The frame pieces are connected together to create a frame of the door having a channel along an interior perimeter. The panels are configured to be inserted within the frame with the channel providing support. The panels include tongues on one side and corresponding grooves on the other side for securing adjacent panels together. The frame pieces and the panels are made from polyvinyl chloride (PVC). The kit also includes a track, roller brackets, handle and hardware. The hardware includes brackets mounted to upper edges of a right side frame and a left side frame to enable the roller brackets to be secured thereto.

20 Claims, 32 Drawing Sheets

(51) Int. Cl.

| | |
|---|---|
| ***E05D 15/06*** | (2006.01) |
| ***E06B 11/04*** | (2006.01) |
| ***E06B 5/02*** | (2006.01) |
| *E05D 15/00* | (2006.01) |
| *E06B 3/00* | (2006.01) |
| *E06B 3/70* | (2006.01) |

(52) U.S. Cl.
CPC ..... *E05D 15/0652* (2013.01); *E06B 5/02* (2013.01); *E06B 11/045* (2013.01); *E05D 15/00* (2013.01); *E05Y 2201/224* (2013.01); *E05Y 2600/51* (2013.01); *E05Y 2600/56* (2013.01); *E06B 3/00* (2013.01); *E06B 2003/7013* (2013.01); *E06B 2003/7098* (2013.01)

(56) References Cited

U.S. PATENT DOCUMENTS 3,003,551 A * 10/1961 Ferris ..... E05D 15/12 160/196.1
3,242,535 A * 3/1966 Ferris ..... E05D 15/063 49/218
4,030,246 A * 6/1977 Naylor ..... E06B 3/721 49/501
4,031,664 A * 6/1977 Wendt ..... E04B 1/6116 248/300
4,182,080 A * 1/1980 Naylor ..... E06B 3/7005 49/163
4,513,554 A * 4/1985 Johnson ..... E06B 3/4636 403/205
4,513,555 A * 4/1985 Johnson ..... E06B 3/721 403/205
4,552,094 A * 11/1985 Johnson ..... A01K 1/0005 119/516
4,680,828 A * 7/1987 Cook ..... E05D 15/0634 16/102
4,872,287 A * 10/1989 Block ..... E05B 65/0823 49/449
4,881,346 A * 11/1989 Block ..... E06B 3/721 49/501
5,775,041 A * 7/1998 Tull ..... E06B 3/10 403/231
6,185,894 B1 * 2/2001 Sisco ..... E06B 3/725 52/455
6,497,938 B1 * 12/2002 Hill ..... B32B 21/06 428/131
8,984,821 B2 * 3/2015 Bruno ..... E06B 3/72 52/210
9,453,367 B1 * 9/2016 Plummer ..... E06B 3/822
2005/0000164 A1 * 1/2005 Jacobs ..... E05D 15/0669 49/425
2005/0210797 A1 * 9/2005 Hees ..... E06B 3/725 52/455
2006/0185250 A1 * 8/2006 Gosling ..... E05F 5/10 49/409
2011/0011003 A1 * 1/2011 Vogel ..... E05F 17/004 49/399
2012/0005964 A1 * 1/2012 Isaacs ..... E05D 15/066 49/452
2012/0211178 A1 * 8/2012 Scott ..... E06B 3/485 160/218
2014/0250629 A1 * 9/2014 Chen ..... E05D 15/063 16/102
2016/0097228 A1 * 4/2016 Wypych ..... E05D 15/0656 16/90
2017/0067276 A1 * 3/2017 Apodaca ..... E05D 15/0639
2017/0204646 A1 * 7/2017 Tomlinson ..... E05F 3/02
2017/0218683 A1 * 8/2017 Shanahan ..... E05F 15/643
2017/0298669 A1 * 10/2017 Boring ..... E05D 15/063
2018/0094464 A1 * 4/2018 Allen ..... E05D 15/0652
2018/0216382 A1 * 8/2018 Wright ..... E05D 15/0652

* cited by examiner

SLIDING BARN DOOR KIT

BACKGROUND

Sliding barn doors have become popular fixtures inside the home. Previously relegated to actual barns, sliding barn doors possess many advantages over more traditional doors that swing on hinges. Some advantages of sliding barn doors include ease of operation and minimal space requirements in comparison to hinged doors. As they do not swing open, sliding barn doors can be more easily utilized in small home spaces, such as bathrooms, or as room separators in small houses. In comparison to other types of sliding doors such as pocket doors, barn doors include decreased construction and installation costs, as well as immense flexibility in size, dimensions, design, and functionality. Because they are generally mounted on one or more tracks outside door frames or openings, sliding barn doors do not necessarily have to match the parameters of a door frame and can be adapted to almost any space and function as space separators, foundations for hangings such as artwork or mirrors, or even serve purely decorative purposes on their own.

By their nature, many sliding barn doors are reclaimed or recycled portions of doors from actual barns. Their popularity, however, has encouraged the construction of sliding barn doors from scratch specifically for use in homes. While lacking the former's rustic charms, manufactured sliding barn doors are generally easier to standardize, or alternatively, customize, and mass-produce. However, the manufactured barn doors are expensive as they require a great deal of upfront labor and craftsmanship before they are sold to the homeowner. Additionally, they are large and thus take up a lot of valuable storefront real estate.

What is needed is an alternative sliding barn door option that is inexpensive to produce, simple to stock and sell, and even allows a homeowner to construct and mount it herself.

BRIEF DESCRIPTION OF DRAWINGS

Some embodiments of the present invention are illustrated as an example and are not limited by the figures of the accompanying drawings, in which like references may indicate similar elements and in which.

DETAILED DESCRIPTION

A barn door kit includes a plurality of packaged pieces that enables the product to be packaged in a much smaller footprint than an assembled door. The kit includes pieces that make up the door including a plurality of frame pieces and a plurality of panels. The frame pieces are configured to be connected together with screws to create the frame of the door. The panels are configured to be inserted within the frame. The panels may include connecting protrusions (tongues) and corresponding receiving indentations (grooves) for securing the panels together. The kit may also include a track, roller brackets, door handle and other components along with hardware for same.

Figure 1:
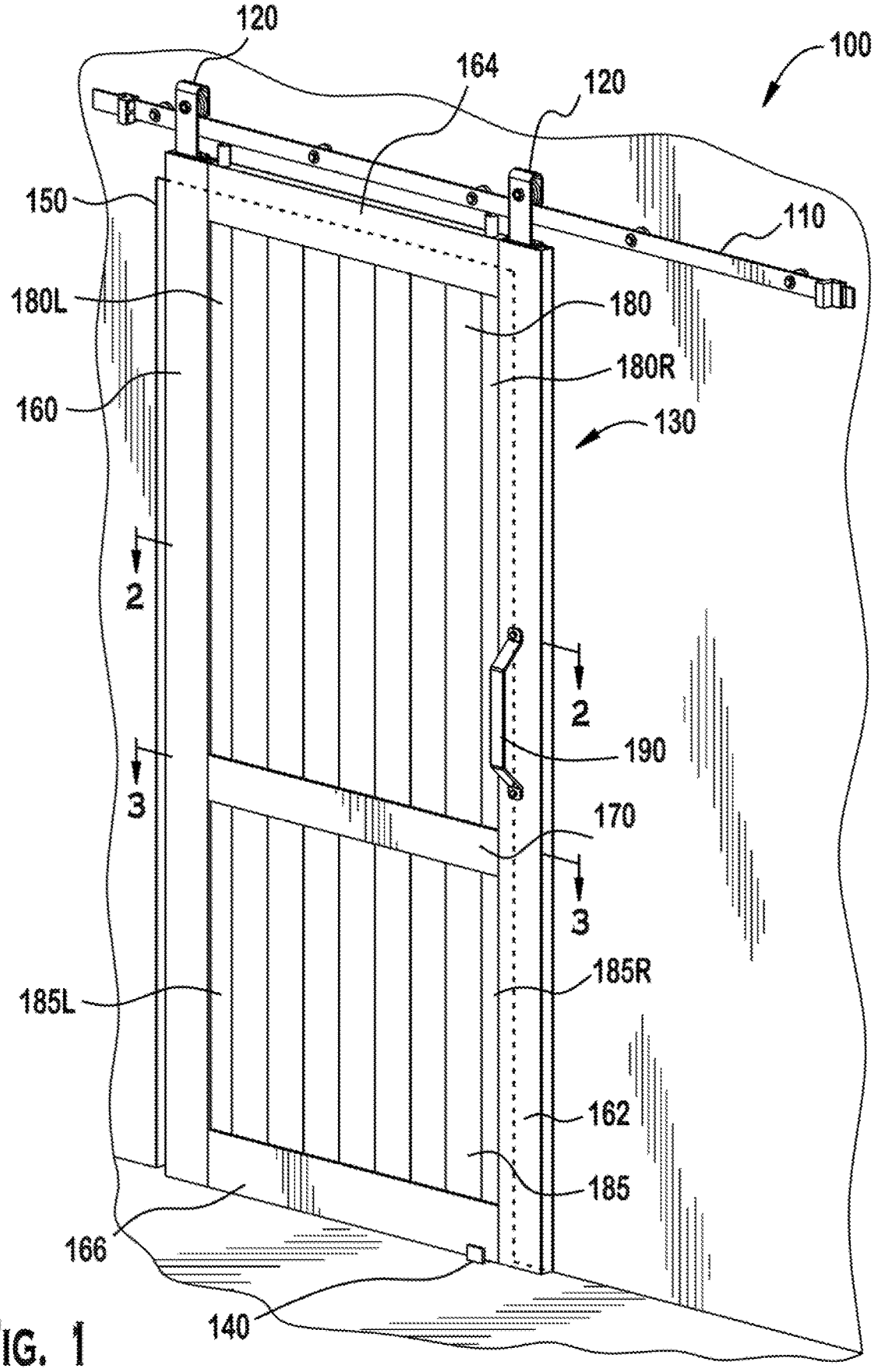
FIG. 1 illustrates a perspective view of a barn door system in use, according to one embodiment.

FIG. 1 illustrates a perspective view of a barn door system 100 in use. The system 100 includes a track 110, roller brackets 120, a barn door 130 and a floor guide 140. The barn door 130 may slide along the track 110 in order to move the door 130 with respect to the doorway or other opening 150 (mostly indicated by dotted line) in order to have the door 130 block all, some or none of the opening 150 (open or close the door 130). The door 130 will not be a solid piece that is rather large and awkward to handle and takes up a substantial amount of real estate. Rather, the door 130 will be a kit that includes a plurality of pieces that can be packaged together as a smaller footprint and can be assembled together after purchase and prior to installation.

The door 130 may include frame pieces (left 160, right 162, upper 164 and lower 166), a center horizontal piece 170, a plurality of upper vertical panels 180, a plurality lower vertical panels 185, and a handle 190. The system 100 includes other pieces not separately illustrated, separately identified, or visible in FIG. 1 for securing the various components together, securing the track 110 to the wall, the door 130 to the track 110, or the like.

According to one embodiment, the left and the right frame pieces 160, 162 may be identical so that they are interchangeable. According to one embodiment, the upper and the lower frame pieces 164, 166 may be identical so that they are interchangeable. According to one embodiment, the plurality of upper vertical panels 180 may be identical so that they are interchangeable. According to one embodiment, the left most and the right most upper vertical panels 180L, 180R may be different then the center upper vertical panels 180 as they may be configured to be received by the left and the right frame pieces 160, 162 respectively. According to one embodiment, the plurality of lower vertical panels 185 may be identical so that they are interchangeable. According to one embodiment, the left most and the right most lower vertical panels 185L, 185R may be different then the center lower vertical panels 185 as they may be configured to be received by the left and the right frame pieces 160, 162 respectively. As illustrated, the plurality of upper vertical panels 180 are longer than the plurality lower vertical panels 185 but in no way are intended to be limited thereby.

According to one embodiment, the various pieces 160, 162, 164, 166, 170, 180, 180L, 180R, 185, 185L, 185R making up the door 130 may be made of the same material. The material may be plastic, such as polyvinyl chloride (PVC). The material should be sturdy, durable and light weight. The various pieces may be extruded plastic.

Figure 2:
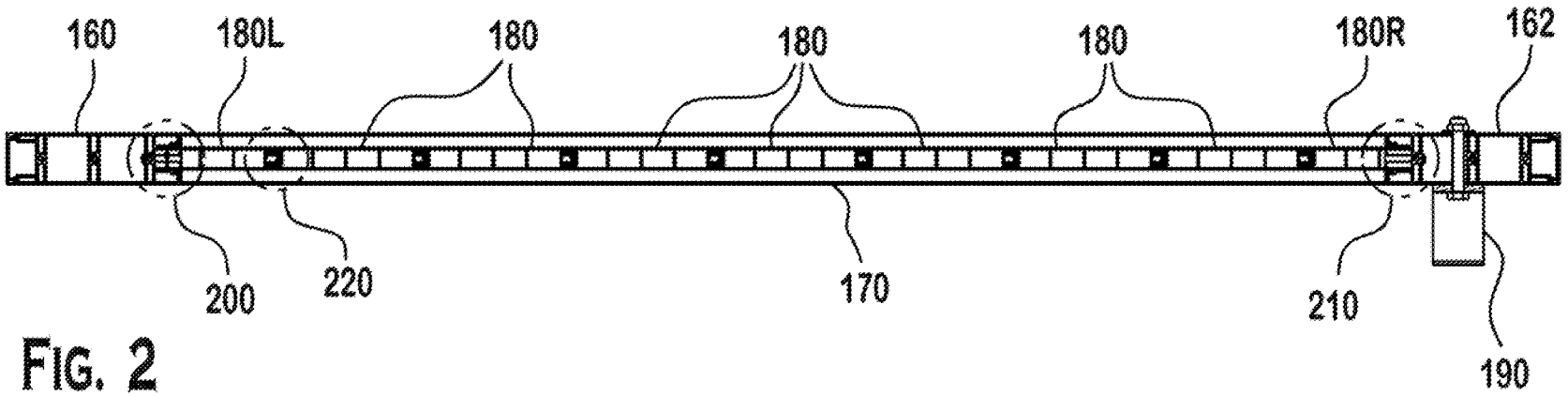
FIG. 2 illustrates a cross sectional view along section 2-2 of FIG. 1, according to one embodiment.

FIG. 2 illustrates a cross sectional view of the door 130 along section 2-2 of FIG. 1. The view illustrates the left frame piece 160, the left most upper vertical panel 180L, a plurality (7 illustrated) of the center upper vertical panels 180, the right most upper vertical panel 180R, the right frame piece 162, the center horizontal piece 170 and the handle 190.

The left frame piece 160 receives the left most upper vertical piece 180L therewithin (identified by circled portion 200). A center upper vertical piece 180 is connected to the left most upper vertical panel 180L and then additional center upper vertical panels 180 are connected to each other and eventually the right most upper vertical panel 180R. The right most upper vertical panel 180R is received by the right frame piece 162 (identified by circled portion 210). The center upper vertical panels 180 may include a tongue on one side and a grove on the other side so that the pieces 180, 180L, 180R can be connected together (individual tongue and grooves are not clearly visible, but a single tongue-groove connection is identified by circled portion 220). The panels 180L, 180R may include only a tongue or a groove as the other side is secured within the left frame piece 160 and the right frame piece 162 respectively.

The right frame piece 162 has the handle 190 connected thereto. The handle 190 may be connected thereto with bolts and nuts, screws, or the like. According to one embodiment, the handle 190 may be connected to the left frame piece 160 if one desired to open from the left side instead of the right side.

Figure 3:
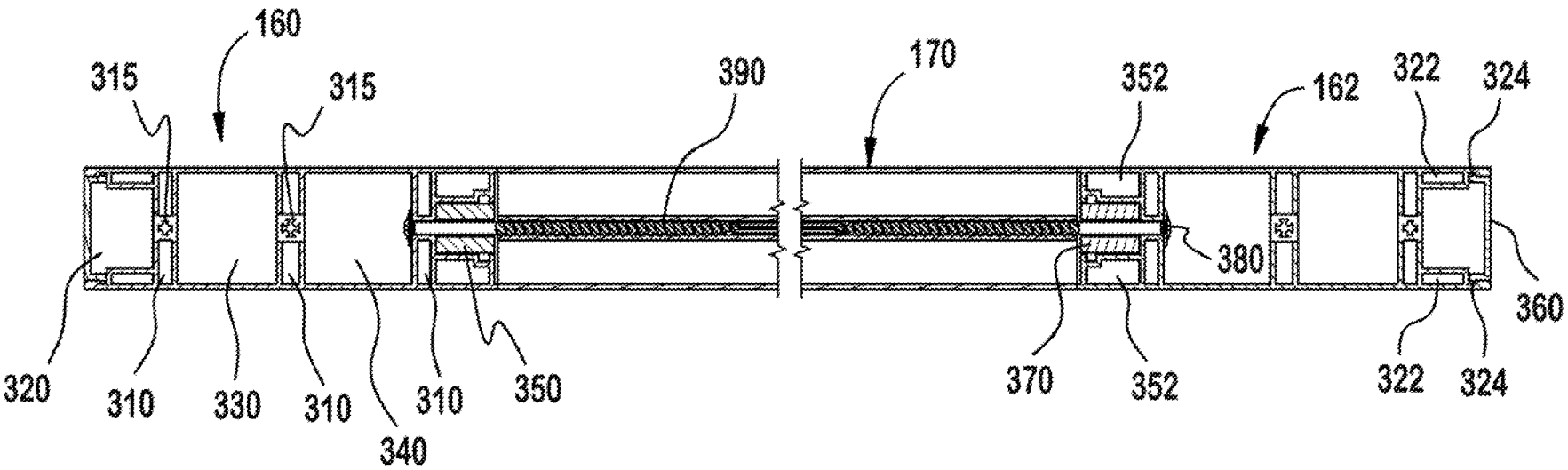
FIG. 3 illustrates a cross sectional view along section 3-3 of FIG. 1, according to one embodiment.

FIG. 3 illustrates a cross sectional view along section 3-3 of FIG. 1. The view illustrates the left frame piece 160, the center horizontal piece 170, and the right frame piece 162. As FIG. 3 illustrates an embodiment where the left and right frame pieces 160, 162 are configured the same, certain features will only be identified on the left 160 while other features will only be identified on the right 162 for ease of illustration. The left and the right frame pieces 160, 162 include a plurality (3 illustrated) of support posts 310. Each support post 310 includes a screw tap 315 formed therein for receiving a screw if desired. As illustrated, the screw taps 315 are substantially centered on the support posts 310.

The support posts 310 separate the left and right frame pieces 160, 162 into exterior sections 320, center sections 330, 340 and interior sections 350. The exterior sections 320 includes walls 322 extending for a portion thereof so as to create lips 324 on each side thereof. The lips 324 are to receive caps 360 to cover the exterior sections 320 to provide a finished look to the frame of the door. The interior sections 350 includes walls 352 extending substantially the length thereof to form an opening in the center thereof to receive a support piece 370. The support piece 370 provides support for screws 380 used to connect the left and right frame pieces 160, 162 and the center horizontal piece 170.

The center horizontal piece 170 includes screw taps 390 formed therein for receiving the screws 380 to connect the center horizontal piece 170 to the left and right frame pieces 160, 162. The screw taps 390 may be formed within support posts that divide the center horizontal piece 170 into sections similar to how the screw taps 315 are formed in the support posts 310 for the left and right frame pieces 160, 162.

Figure 4:
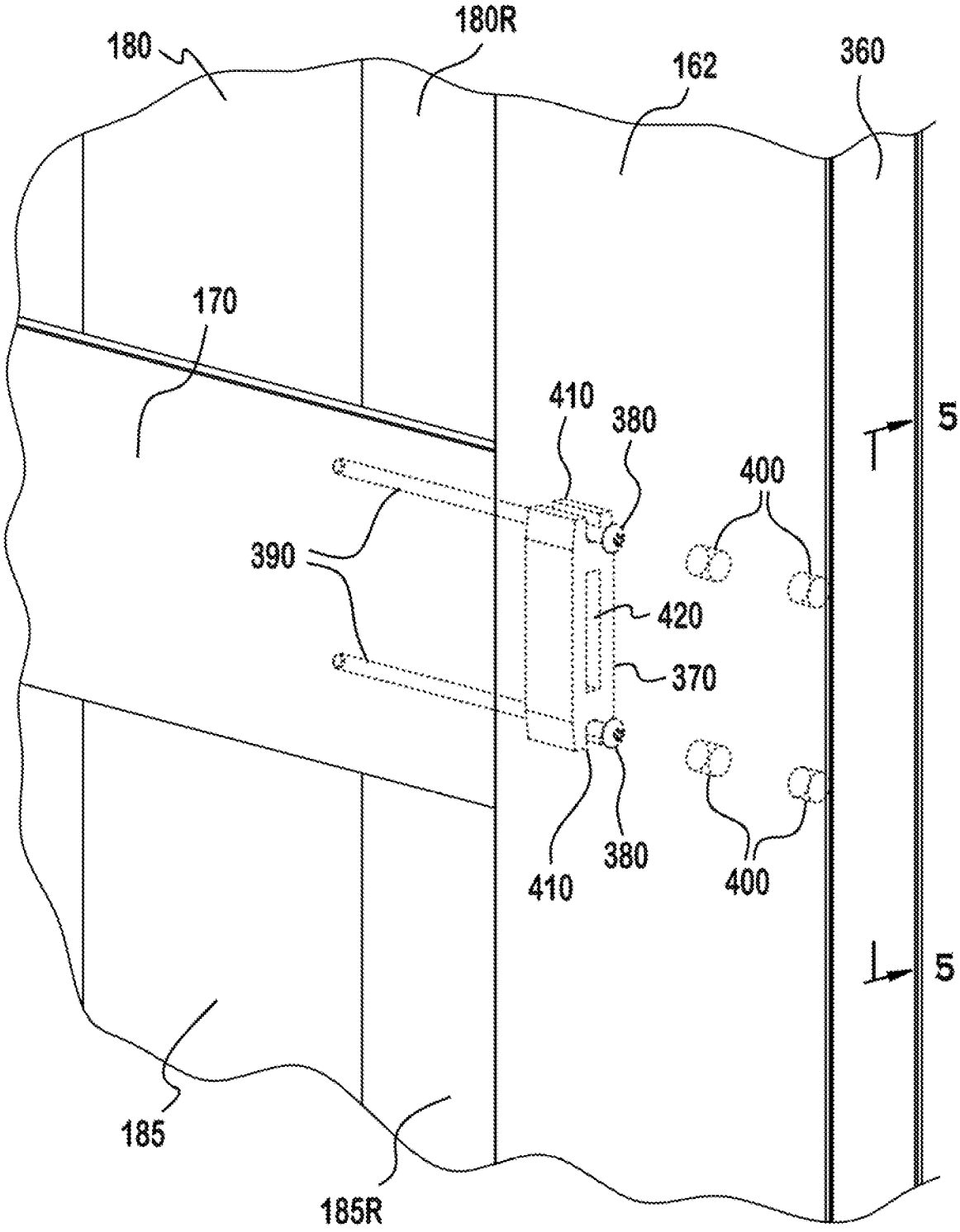
FIG. 4 illustrates a close up view of a connection between the right frame piece and the center horizontal piece of FIG. 1, according to one embodiment.

FIG. 4 illustrates a close up view of a connection between the right frame piece 162 and the center horizontal piece 170 of FIG. 1. The view also includes internal components illustrated in doted lines. The right frame piece 162 and the center horizontal piece 170 abut one another with the right frame piece 162 traversing vertically and the center horizontal piece 170 traversing horizontally. The right frame piece 162 has holes 400 formed in all but last of the supports 310 (not visible) large enough to enable the screws 380 to pass therethrough. A hole (not visible) formed in the last support 310 (not visible) is smaller so as to support a head of the screws 380 (not allow the screws to pass therethrough). The support piece 370 is located within the interior section 350 (not visible) of the right frame piece 162. The support piece 370 may include holes 410 formed in top and bottom for receiving the screws 380. As illustrated, the holes 410 are open ended but is in no way intended to be limited thereby. The support piece 370 may include an opening 420 therein to limit the amount of material required. The screws 380 are received by the screw taps 390 in the center horizontal piece 170.

The upper vertical panels 180, 180R and the lower vertical panels 185, 185R are illustrated in alignment with the right frame piece 162 and extending up or down from the center horizontal piece 170. It should be noted that in an embodiment where the left and right frame pieces 160, 162 are configured the same that the left frame piece 160 would connect to the center horizontal piece 170 in the same manner.

Figure 5:
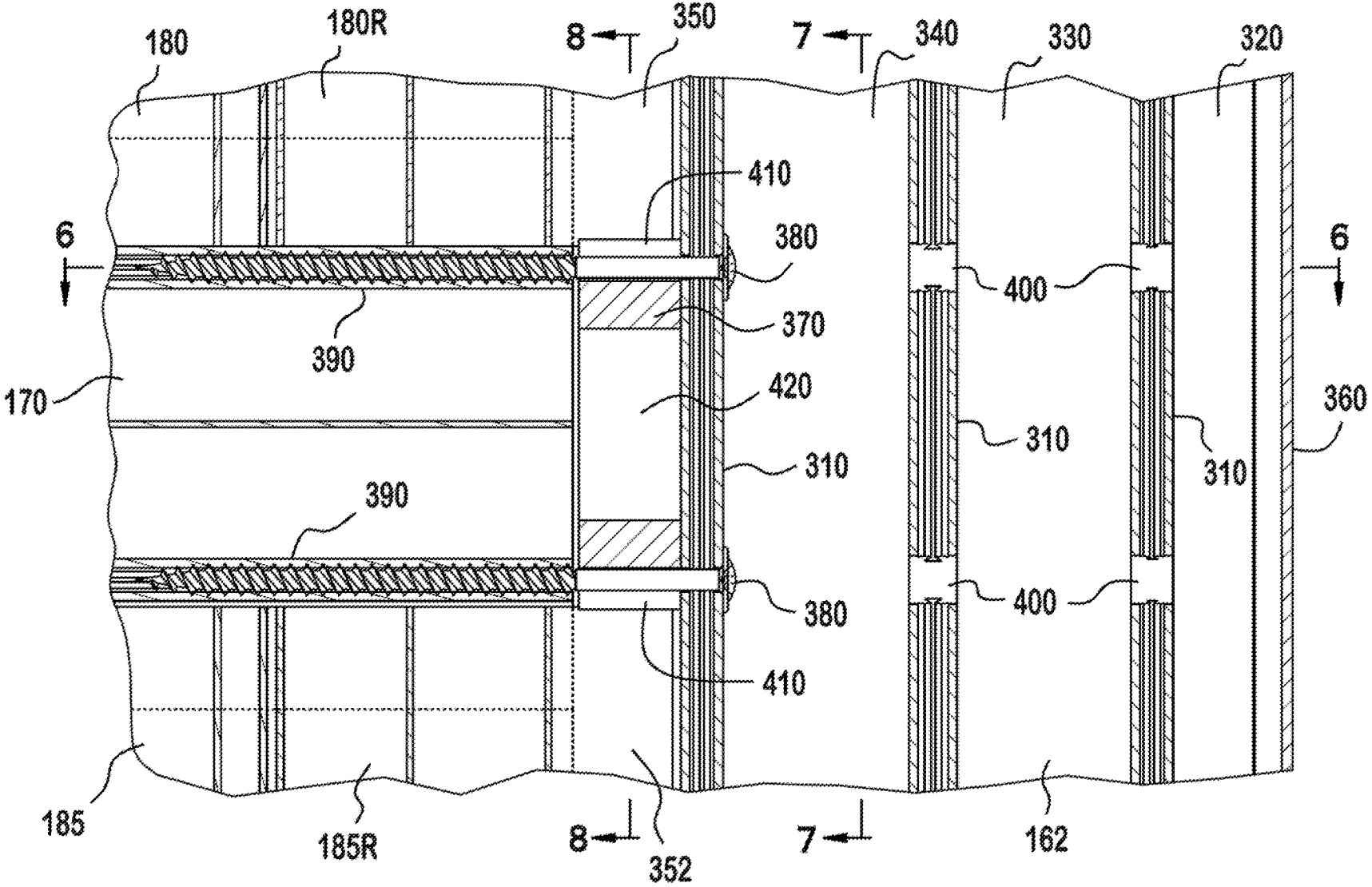
FIG. 5 illustrates a cross sectional view along section 5-5 of FIG. 4, according to one embodiment.

FIG. 5 illustrates a cross sectional view along section 5-5 of FIG. 4. The view illustrates the right frame piece 162 connecting to the center horizontal piece 170. The exterior (right most) and center supports 310 within the right frame piece 162 have the holes 400 formed therein to enable the screws 380 to pass therethrough. The interior (left most) support 310 includes smaller holes (not obviously visible or separately identified) for allowing the threaded body of the screws 380 through but supporting the heads of the screws 380. The support piece 370 is located within the interior section 350 and is supported by the walls 352. The threaded body of the screws 380 pass through the last support 310 and the support piece 370 and into the screw taps 390 in the center horizontal piece 170 to secure the pieces together.

Figure 6:
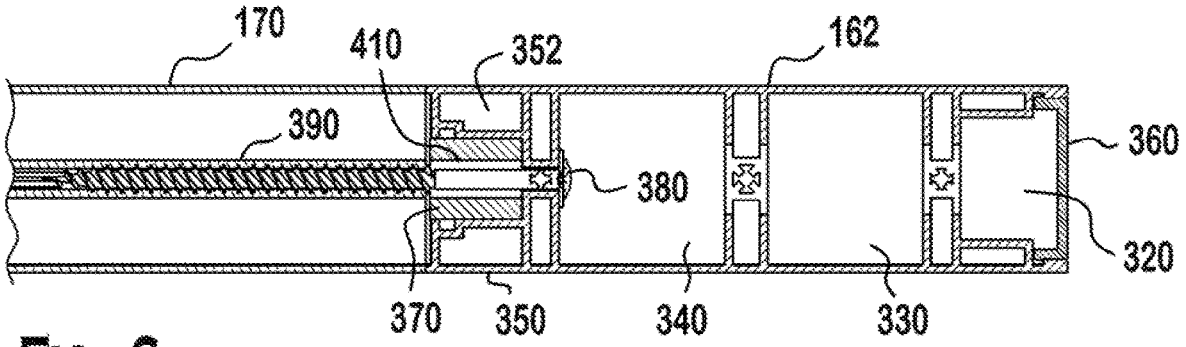
FIG. 6 illustrates a cross sectional view along section 6-6 of FIG. 5, according to one embodiment.

FIG. 6 illustrates a cross sectional view along section 6-6 of FIG. 5. The view illustrates the right frame piece 162 connecting to the center horizontal piece 170. The screw 380 passes through the right frame piece 162, the support piece 370 and into the screw taps 390 in the center horizontal piece 170. The support piece 370 is located within the interior section 350 and is secured by the walls 352.

Figure 7:
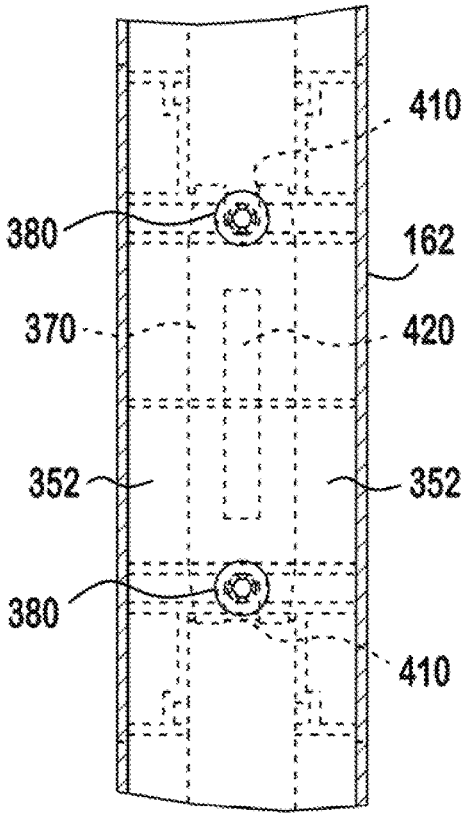
FIG. 7 illustrates a cross sectional view along section 7-7 of FIG. 5, according to one embodiment.
Figure 8:
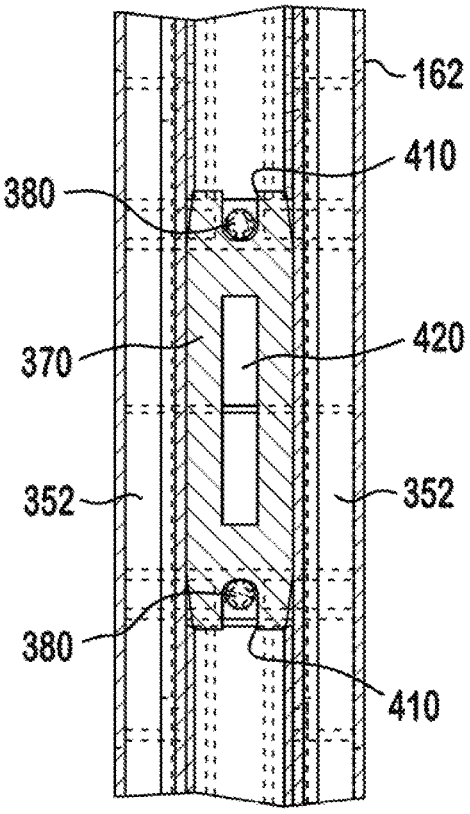
FIG. 8 illustrates a cross sectional view along section 8-8 of FIG. 5, according to one embodiment.

FIGS. 7 and 8 illustrate cross sectional views along section 7-7 and 8-8 of FIG. 5 respectively. The views illustrate the support piece 370 and the screws 380 within the interior section 350 (not visible) of the right frame piece 162. The walls 352 abut the support piece 370.

Figure 9:
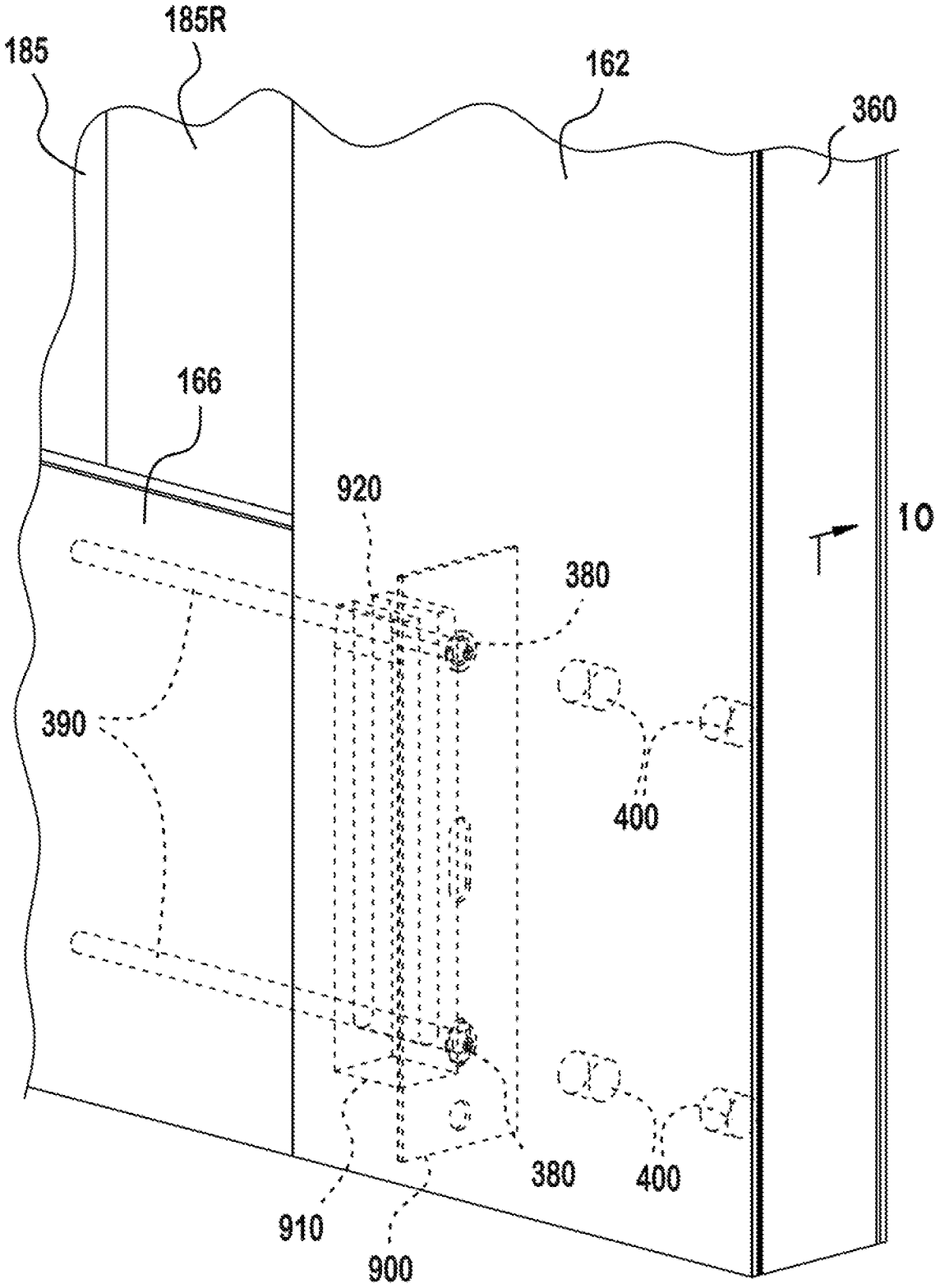
FIG. 9 illustrates a close up view of a connection between the right frame piece and the lower frame piece of FIG. 1, according to one embodiment.

FIG. 9 illustrates a close up view of a connection between the right frame piece 162 and the lower frame piece 166 of FIG. 1. The view also includes internal components illustrated in doted lines. The right frame piece 162 and the lower frame piece 166 abut one another with the right frame piece 162 traversing vertically and the lower frame piece 166 traversing horizontally. The right frame piece 162 has holes 400 formed in all but last of the supports 310 (not visible) large enough to enable the screws 380 to pass therethrough. A hole (not visible) formed in the last support 310 (not visible) is smaller so as to support a head of the screws 380 (not allow the screws to pass therethrough).

A support plate 900 and a support piece 910 may be utilized to assist with securing the right frame piece 162 and the lower frame piece 166. The support plate 900 may be located in the center section 340 (not visible) of the right frame piece 162 resting upon the support 310 (not visible) separating it from the interior section 350 (not visible). The support piece 910 may be located within the interior section 350. The support plate 900 may have holes formed in top and bottom for receiving the screws 380. The support piece 910 may also include holes or may include an open slot 920 (as illustrated the support piece is U shaped) for receiving the screws 380. The screws 380 are received by screw taps 390 formed in the support posts within the lower frame piece 166 (similar to the center horizontal piece 170 described above).

The lower vertical panels 185, 185R are illustrated in alignment with the right frame piece 162 and extending up from the lower frame piece 166. It should be noted that in an embodiment where the left and right frame pieces 160, 162 are configured the same that the left frame piece 160 would connect to the lower frame piece 166 in the same manner.

Figure 10:
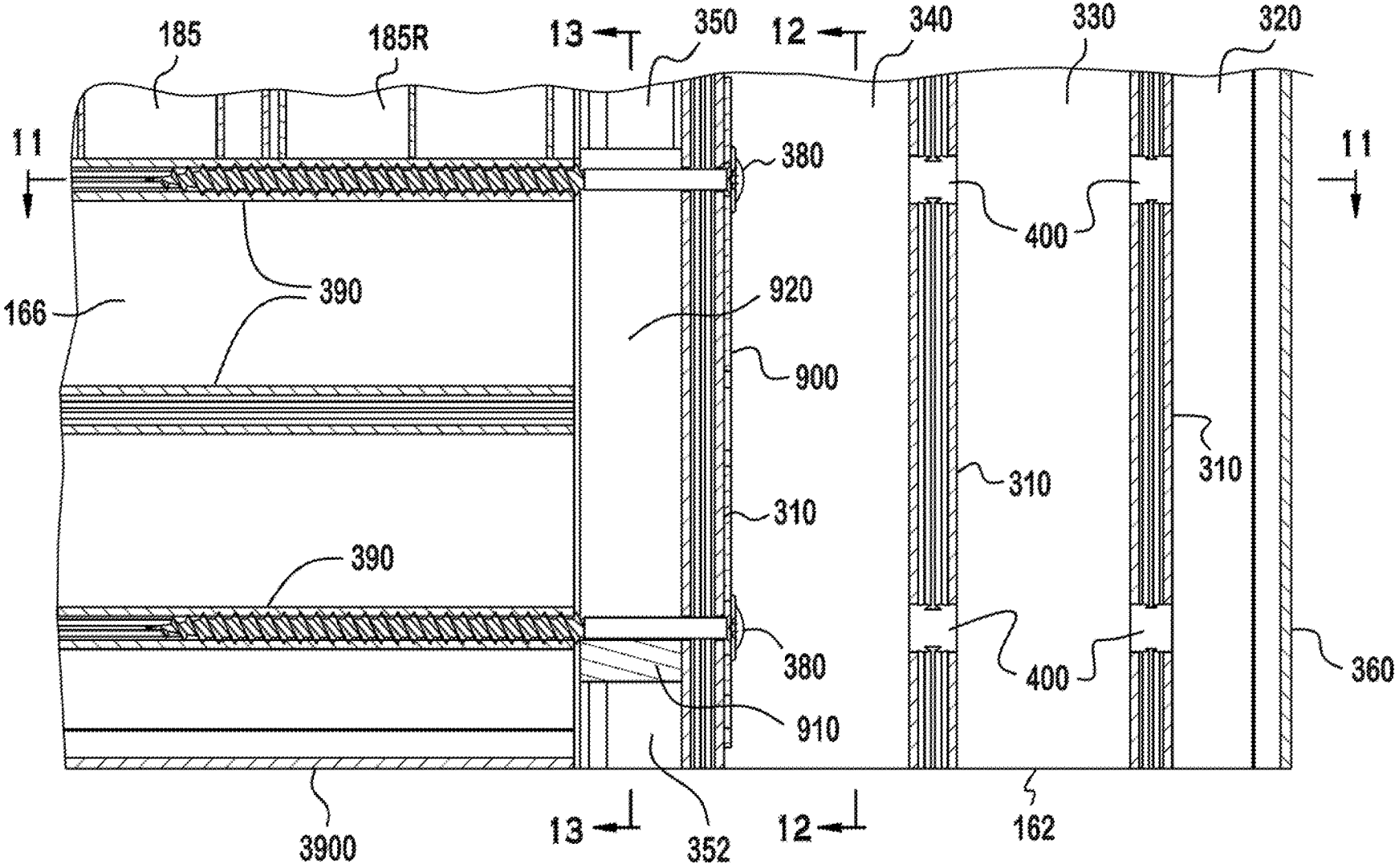
FIG. 10 illustrates a cross sectional view along section 10-10 of FIG. 9, according to one embodiment.

FIG. 10 illustrates a cross sectional view along section 10-10 of FIG. 9. The view illustrates the right frame piece 162 connecting to the lower frame piece 166. The exterior (right most) and center supports 310 within the right frame piece 162 have the holes 400 formed therein to enable the screws 380 to pass therethrough. The interior (left most) support 310 includes smaller holes (not obviously visible or separately identified) for allowing the threaded body of the screws 380 through but supporting the heads of the screws 380. The support plate 900 is located within the center section 340 abutting the support 310 dividing it from the interior section 350. The support piece 910 is located within the interior section 350 of the right frame piece 162. The threaded body of the screws 380 pass through the support plate 900, the support 310 and the support piece 910 and into the screw taps 390 in the lower frame piece 166 to secure the pieces together.

Figure 11:
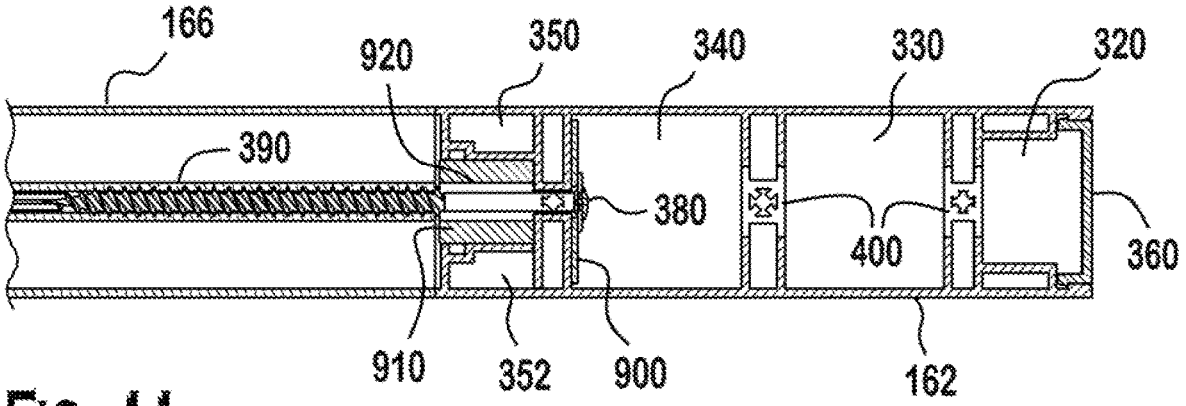
FIG. 11 illustrates a cross sectional view along section 11-11 of FIG. 10, according to one embodiment.

FIG. 11 illustrates a cross sectional view along section 11-11 of FIG. 10. The view illustrates the right frame piece 162 connecting to the lower frame piece 166. The screw 380 passes through the right frame piece 162, the support plate 900 and the support piece 910 and into the screw taps 390 in the lower frame piece 166. The support piece 910 is located within the interior section 350 and is secured by the walls 352.

Figure 12:
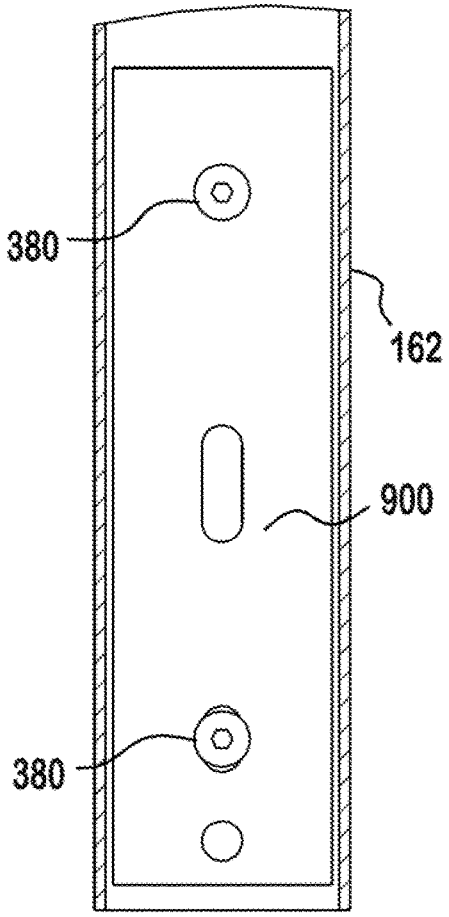
FIG. 12 illustrates a cross sectional views along section 12-12 of FIG. 11, according to one embodiment.

FIG. 12 illustrates a cross sectional views along section 12-12 of FIG. 11. The view illustrates the support plate 900 and the heads of the screws 380 within the center section 340 (not visible) of the right frame piece 162.

Figure 13:
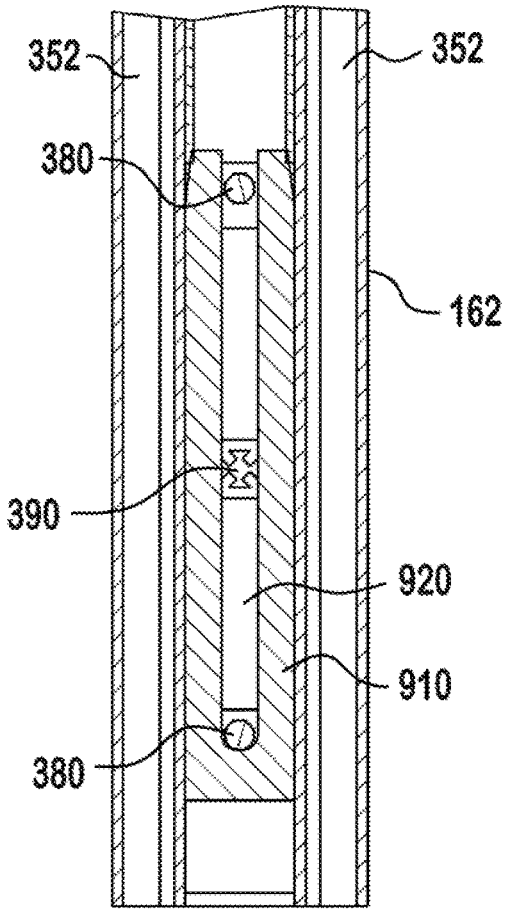
FIG. 13 illustrates a cross sectional views along section 13-13 of FIG. 11, according to one embodiment.

FIG. 13 illustrates a cross sectional views along section 13-13 of FIG. 11. The view illustrates the support piece 910 and the threads of the screws 380 within the interior section 350 (not visible) of the right frame piece 162. The walls 352 abut the support piece 910.

Figure 14:
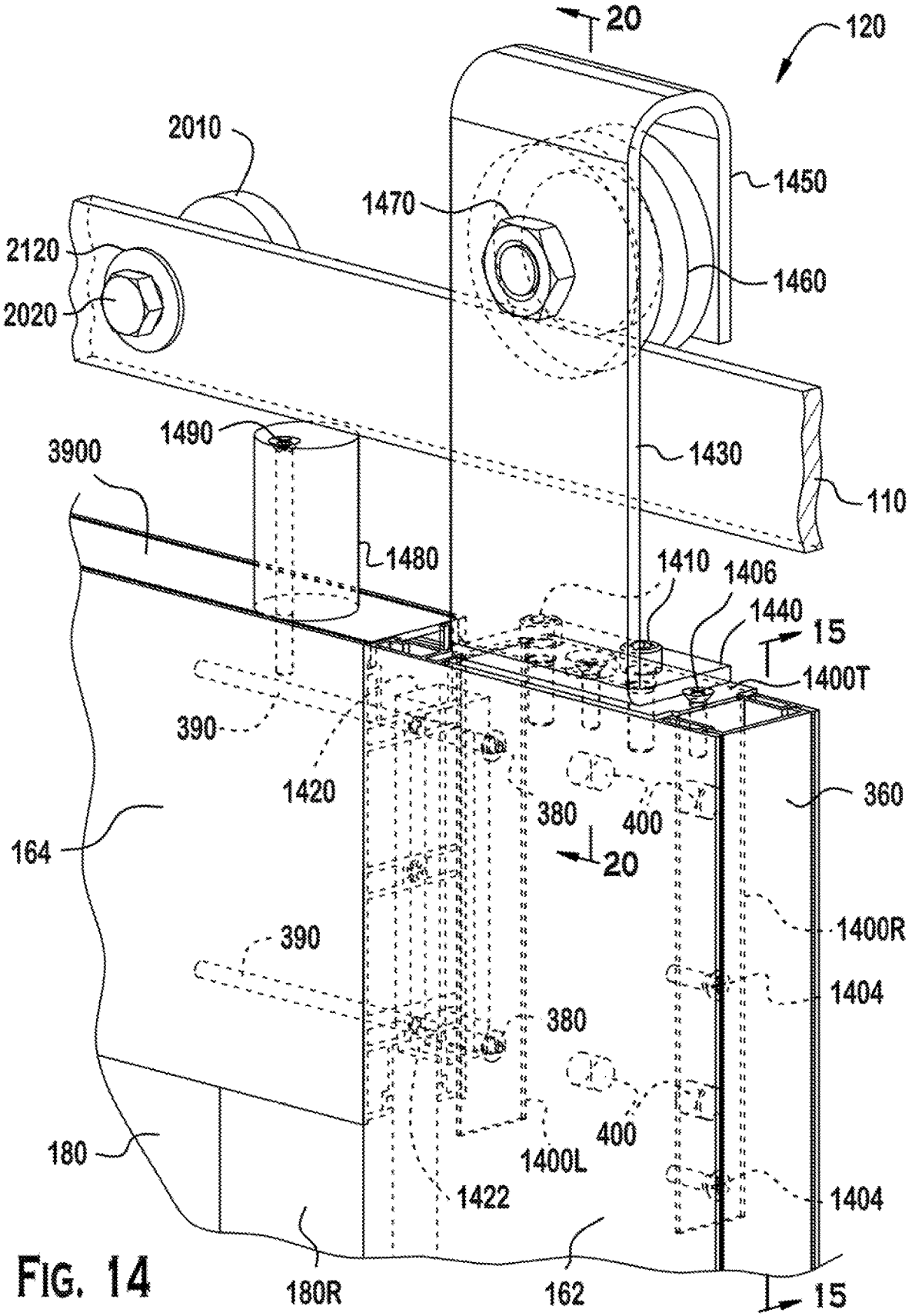
FIG. 14 illustrates a close up view of a connection between the right frame piece, the upper frame piece, and the roller bracket of FIG. 1, according to one embodiment.

FIG. 14 illustrates a close up view of a connection between the right frame piece 162, the upper frame piece 164, and the roller bracket 120 of FIG. 1. The view also includes internal components illustrated in doted lines. The right frame piece 162 and the upper frame piece 164 abut one another with the right frame piece 162 traversing vertically and the upper frame piece 164 traversing horizontally. The right frame piece 162 has holes 400 formed in all but last of the supports 310 (not visible) large enough to enable the screws 380 to pass therethrough. A hole (not visible) formed in the last support 310 (not visible) is smaller so as to support a head of the screws 380 (not allow the screws to pass therethrough).

A support bracket 1400 may be utilized to assist with securing the roller bracket 120 and the upper frame piece 164 to the right frame piece 162. The support bracket 1400 may be shaped like an upside down U where a top may be located along the top of the right frame piece 162 and the legs (sides) of the U may extend into different sections and be secured to the supports 310 (not illustrated). The first (right) leg of the support bracket 1400R may be located in the exterior section 320 (not visible) of the right frame piece 162 resting upon the support 310 (not visible) separating it from the center section 330 (not visible). The second leg (left) 1400L may be located in the center section 340 (not visible) of the right frame piece 162 resting upon the support 310 (not visible) separating it from the interior section 350 (not visible).

The right leg of the support bracket 1400R may have holes 1402 formed therein in alignment with the holes 400 in the supports 310 to allow the entire screws 380 to pass therethrough. The left leg of the support bracket 1400L may have smaller holes (not separately illustrated) formed therein in alignment with the smaller holes in the supports 310 to allow the thread of the screws 380 to pass therethrough and to support a head of the screws 380. The screws 380 may secure the left leg 1400L to the support 310 separating the center section 340 from the interior section 350. The right leg 1400R may also have smaller holes formed therein (not identified separately) for receiving smaller screws 1404 to secure the right leg 1400R to the support 310 separating the exterior section 320 from the center section 330.

The top of the bracket 1400T located along the top of the right frame piece 162 may include holes (not visible) in alignment with the screw taps 315 in the supports 310. Screws 1406 may be utilized to secure the top of the support bracket 1400T to an upper edge of the right frame piece 162 by threading the screws 1406 through the holes and into the screw taps 315. The top 1400T may also include threaded screw holes 1408 configured to be over the center sections 330, 340 of the right frame piece 162.

The roller bracket 120 may include a main body 1430, a connection flange 1440, a wraparound arm 1450, a wheel 1460 and a connection means (e.g., bolt, nut, washers) 1470. The main body 1430 is configured to extend upward from a top edge of the right frame piece 162 in alignment with a front face of the right frame piece 162. The connection flange 1440 is configured to extend perpendicular from a bottom of the the main body 1430 so as to be flush with the top edge of the right frame piece 162. The connection flange 1440 may include holes in alignment (not identified) with the threaded screw holes 1408 in the top of the support bracket 1400T. The screws 1410 may pass through the holes in the connection flange 1440 into the threaded screw holes 1408 to secure the roller bracket 120 to the top of the support bracket 1400T and thus the right frame piece 162.

The wrap around arm 1450 is configured to extend backwards from the front face of the right frame piece 162 and then down toward the top of right frame piece 162 so as to form a channel (not identified) between the main body 1430 and the downward extending portion of the wrap around arm 1450. Holes (not identified) may be formed in both the main body 1430 and the downward extending portion of the wrap around arm 1450 in alignment with each other. The wheel 1460 having a hole formed in the center thereof (not identified) may be located in the channel such that the hole is aligned with the holes in the main body 1430 and the downward extending portion of the wrap around arm 1450. The wheel 1460 may be secured therein by passing the connections means 1470 through the aligned holes in the main body 1430, the wheel 1460 and the downward extending portion of the wrap around arm 1450. The connection means 1470 may include a bolt that passes through the holes and then is secured therein with a nut. The connection means 1470 may also include one or more washes to assist in alignment of the wheel 1460 centrally within the channel.

A support piece 1420 may be utilized to assist with securing the right frame piece 162 to the upper frame piece 164. The support piece 1420 may be located within the interior section 350 of the right frame piece 162. The support piece 1420 may include holes or may include an open slot 1422 (as illustrated the support piece is upside down U shaped) for receiving the screws 380. The screws 380 are received by screw taps 390 formed in the support posts within the upper frame piece 164 (similar to the center horizontal piece 170 described above).

A safety spacer 1480 is also illustrated as being mounted to an upper edge of the upper frame piece 164. The safety spacer 1480 is secured to the upper frame piece 164 via a screw 1490. The safety spacer 1480 is to prevent the door 130 from being able to be removed from the track 110 after installation. The safety spacer 1480 may be capable of rotating between a position where it is in alignment with the track 110 and thus prevents the door 130 from being installed on or removed from the track 110 and a position where it is not aligned with the track 110 and therefore allows the door 130 to be installed on or removed from the track 110. As illustrated, the safety spacer 1480 is in close proximity to the roller bracket 120 and the right frame piece 162. It should be noted that another safety spacer 1480 may be installed on the other side of the door 130 in close proximity to the other roller bracket 120 and the left frame piece 160.

The upper vertical panels 180, 180R are illustrated in alignment with the right frame piece 162 and extending down from the upper frame piece 164. It should be noted that in an embodiment where the left and right frame pieces 160, 162 are configured the same that the left frame piece 160 would connect to the upper frame piece 164 in the same manner.

Figure 15:
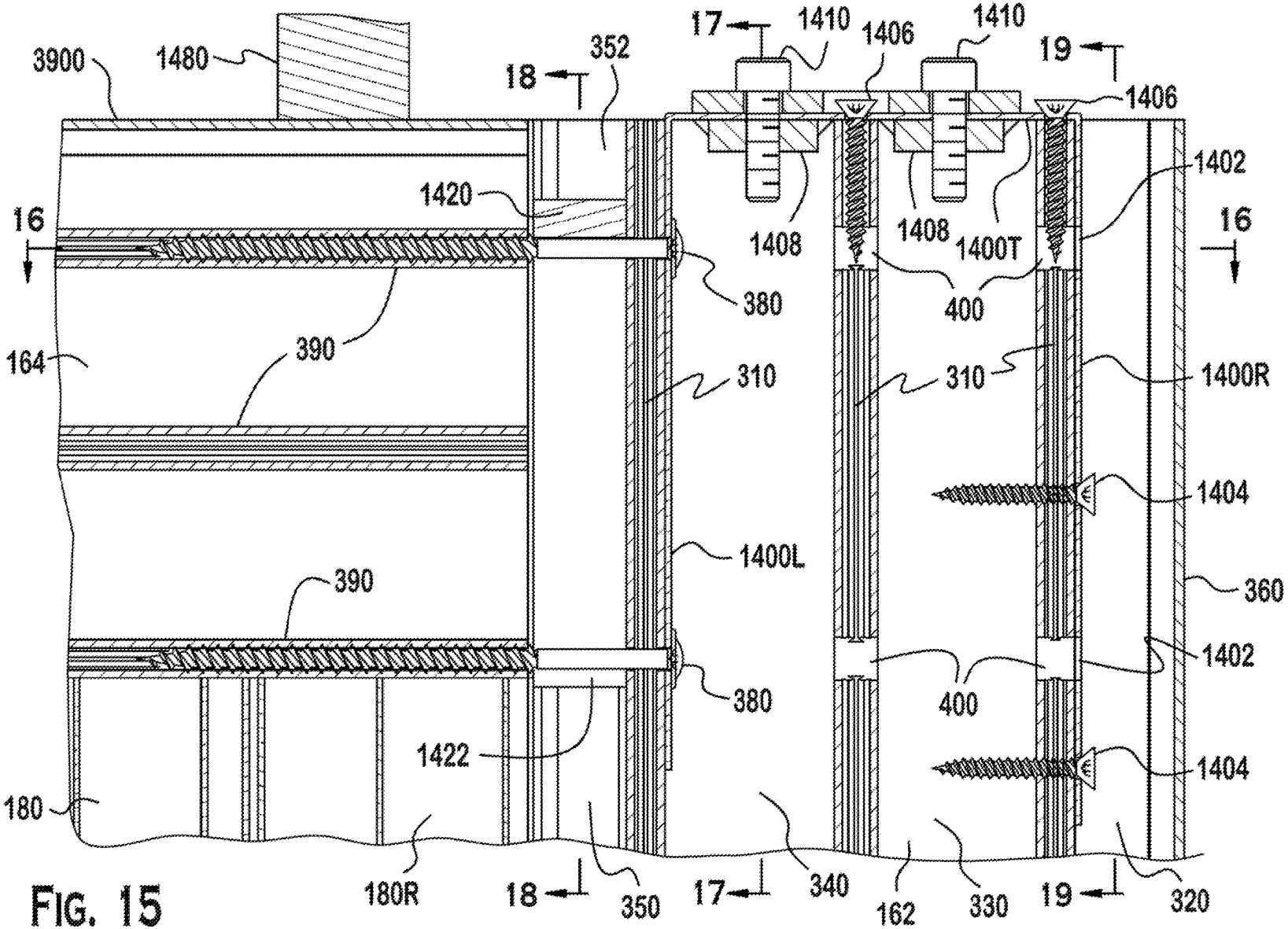
FIG. 15 illustrates a cross sectional view along section 15-15 of FIG. 14, according to one embodiment.

FIG. 15 illustrates a cross sectional view along section 15-15 of FIG. 14. The view illustrates the right frame piece 162 connecting to the upper frame piece 164. The left leg 1400L is located in the center section 340 abutting the support 310 dividing it from the interior section 350. The top 1400T rests on the top of the right frame piece 162. The right leg 1400R is located in the exterior section 320 abutting the support 310 dividing it from the center section 330. The holes 1402 in the right leg 1400R are in alignment with the holes 400 in the supports 310 to allow the entire screws 380 to pass therethrough. The right leg 1400R is secured to the support 310 separating the exterior section 320 from the center section 330 with the screws 1404. The left leg 1400L is secured to the support 310 separating the center section 340 and the interior section 350 with the screws 380 that also secure the right frame piece 162 and the upper frame piece 164. The screws 1406 secure the top of the bracket 1400T to the right frame piece 162 by passing through the holes in the top 1400T and into the screw taps 315 in the supports 310.

The roller bracket 120 is secured to the top of the bracket 1400T and accordingly the right frame piece 162 by passing the screws 1410 through the holes in the connection flange 1440 into the threaded screw holes 1408 in the top of the support bracket 1400T. The support piece 1420 is located within the interior section 350 of the right frame piece 162. The threaded body of the screws 380 pass through the left leg 1400L, the support 310 and the support piece 1420 and into the into the screw taps 390 in the upper frame piece 164 to secure the pieces together.

Figure 16:
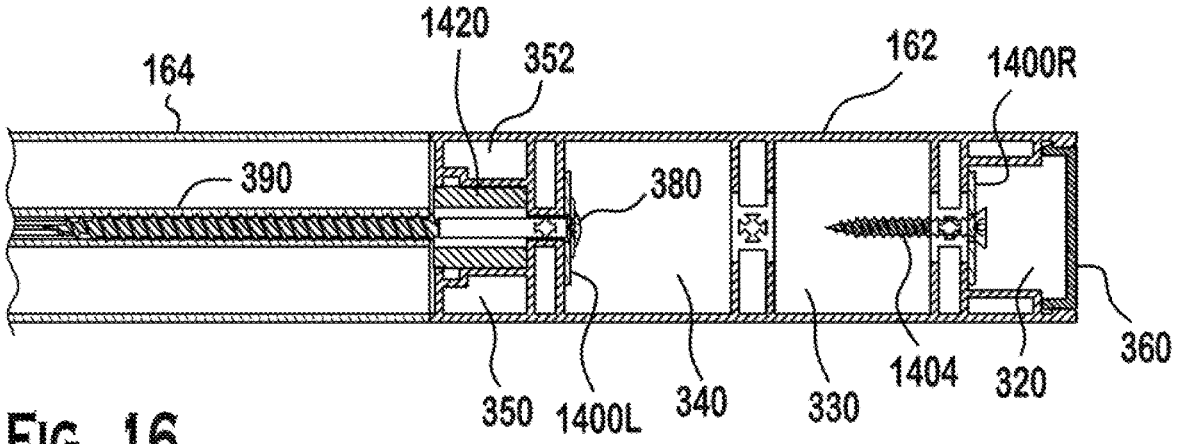
FIG. 16 illustrates a cross sectional view along section 16-16 of FIG. 15, according to one embodiment.

FIG. 16 illustrates a cross sectional view along section 16-16 of FIG. 15. The view illustrates the screw 380 securing the right frame piece 162 and the upper frame piece 164. The threads of the screw 380 pass through the left leg 1400L, the support 310 and the support piece 1420 and are received by the screw taps 390 in the upper frame piece 164. The head of the screws 380 rest on the left leg 1400L which secures the left leg 1400L to the support 310 separating the middle section 340 and the interior section 350. The support piece 1420 is located within the interior section 350 between the walls 352. The right leg 1400R is secured to the support 310 separating the exterior section 320 from the middle section 330 with the smaller screws 1404.

Figure 17:
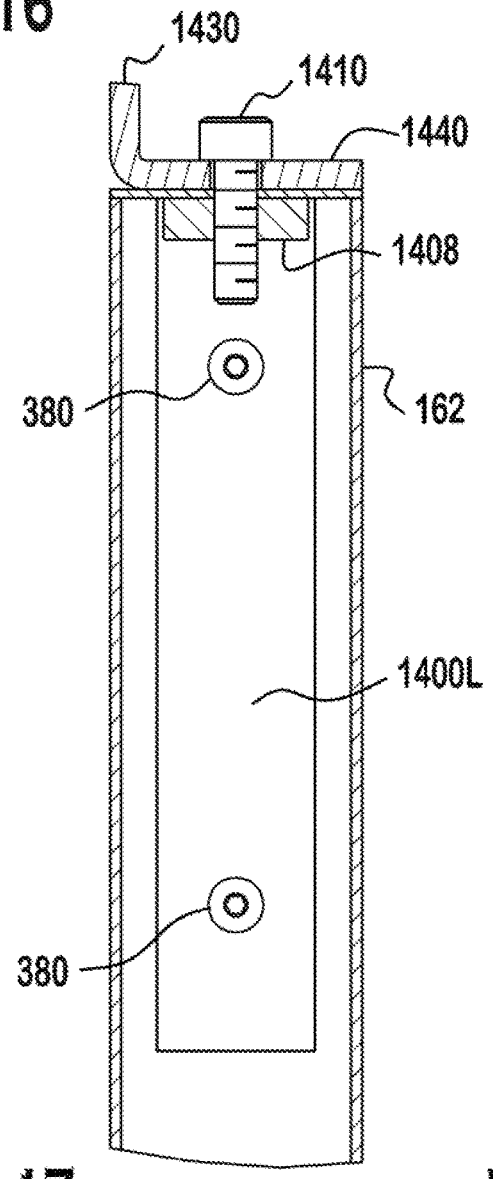
FIG. 17 illustrates a cross sectional view along section 17-17 of FIG. 15, according to one embodiment.

FIG. 17 illustrates a cross sectional view along section 17-17 of FIG. 15. The view illustrates the connection flange 1440 of the roller bracket 120 being secured to the right frame piece 162 by threading the screws 1410 into the threaded screw holes 1408 in the top of the support bracket 1400T. The left leg 1400L is within the center section 340 (not visible) and is secured to the support 310 (not visible) separating the center section 340 and the interior section 350 (not visible) with the screws 380.

Figure 18:
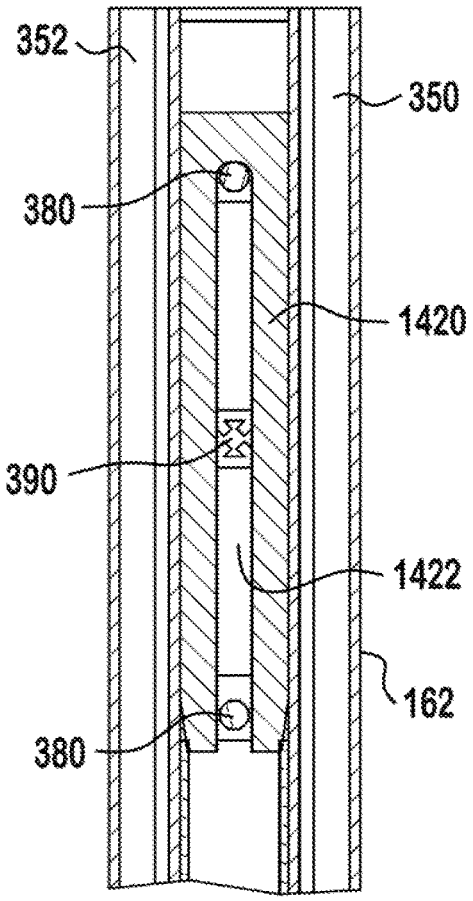
FIG. 18 illustrates a cross sectional view along section 18-18 of FIG. 15, according to one embodiment.

FIG. 18 illustrates a cross sectional view along section 18-18 of FIG. 15. The view illustrates the support piece 1420 and the threads of the screws 380 within the interior section 350 (not visible) of the right frame piece 162. The walls 352 abut the support piece 1420.

Figure 19:
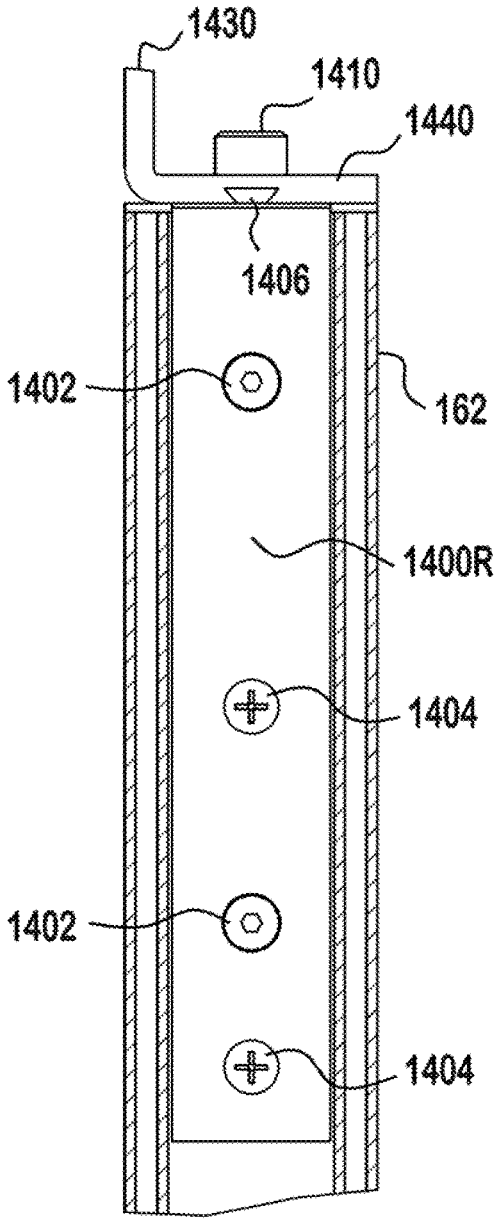
FIG. 19 illustrates a cross sectional view along section 19-19 of FIG. 15, according to one embodiment.

FIG. 19 illustrates a cross sectional view along section 19-19 of FIG. 15. The view illustrates the right leg 1400R within the exterior section 320 (not visible) and being secured to the support 310 (not visible) separating the exterior section 320 and the center section 330 (not visible) with the screws 1404. The holes 1402 allowed the screws 380 to pass therethrough. The top 1400T (not visible) is connected to the right frame piece 162 via the screws 1406. The connection flange 1440 of the roller bracket 120 is secured to the top 1400T via the screws 1410.

Figure 20:
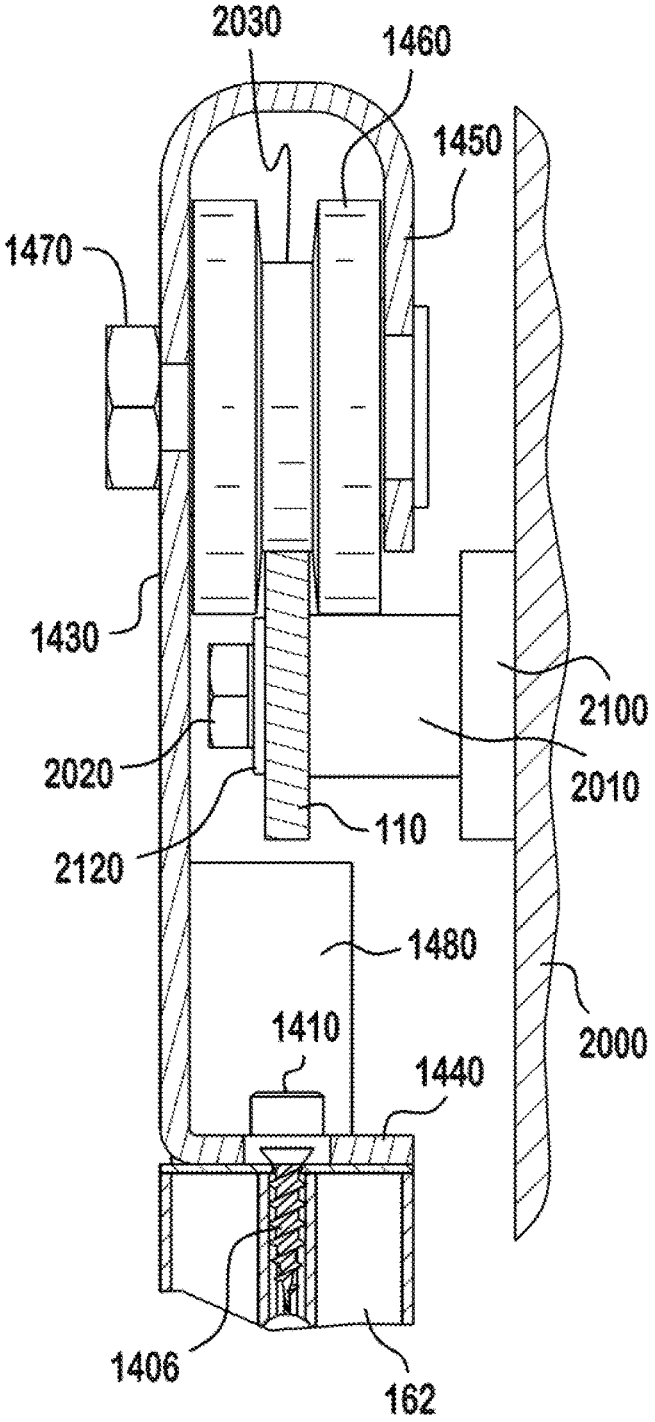
FIG. 20 illustrates a cross sectional view along section 20-20 of FIG. 14, according to one embodiment.

FIG. 20 illustrates a cross sectional view along section 20-20 of FIG. 14. The view illustrates the connection flange 1440 of the roller bracket 120 secured to the right frame piece 162 via the screws 1410. The track 110 is spaced from a wall 2000 using a spacer 2010 and is secured to the spacer 2010 and mounted to the wall 2000 with a bolt 2020. The wheel 1460 of the roller bracket 120 includes a groove 2030 formed therein for receiving the track 110.

Figure 21:
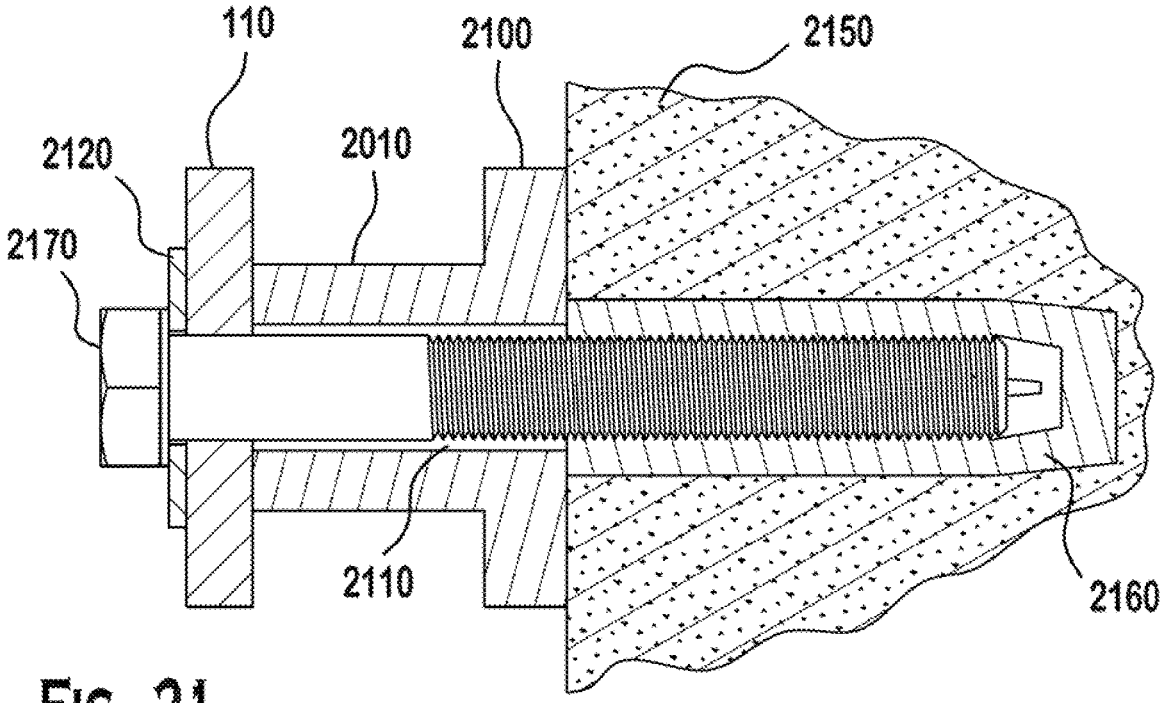
FIG. 21 illustrates a cross sectional views of the track being secured to a masonry wall, according to one embodiment.
Figure 22:
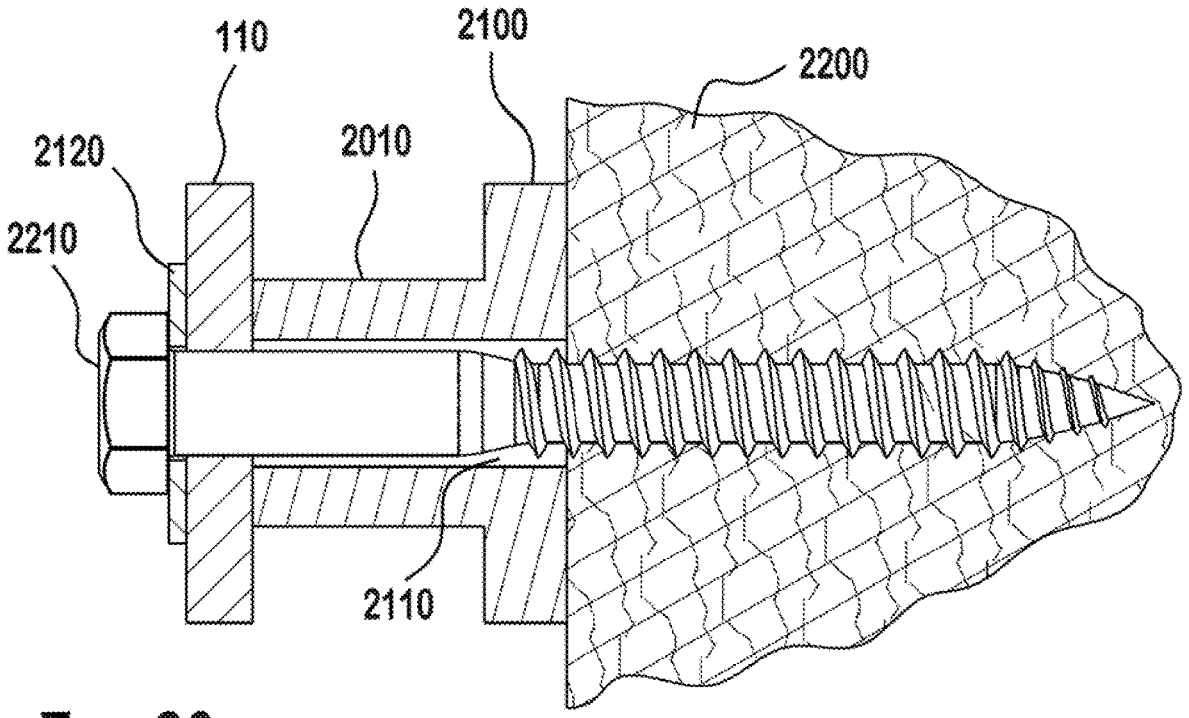
FIG. 22 illustrates a cross sectional views of the track being secured to a mounting board/stud wall, according to one embodiment.

FIGS. 21 and 22 illustrate cross sectional views of the track 110 being secured to a wall (masonry in FIG. 21 and mounting board/stud in FIG. 22). The track 110 may have holes (not separately identified) formed therein at defined intervals for securing the track 110 to the wall. The spacers 2010 may be aligned with the holes in the track 110 to space the track 110 a defined distance from the wall. The spacers 2010 include a wide portion 2100 that rests upon the wall. The spacers 2010 include holes 2110 formed therein that are to be aligned with the holes in the track 110. The bolts traverse the holes in the track 110 and the holes 2110 in the spacer 2010 and are secured in the wall. According to one embodiment, the bolts may pass through washers 2120 prior to passing through the track 110.

FIG. 21 illustrates the mounting of the track 110 to a masonry wall 2150. An anchor 2160 is installed in the masonry wall 2150 and the anchor 2160 receives a masonry bolt 2170. FIG. 22 illustrates the mounting of the track 110 directly into a stud 2200 of a mounting board wall. The stud 2200 directly receives a mounting board bolt 2210. It should be noted that if a stud 2200 is not available behind the mounting board wall at the point of installation that a toggle bolt or the like may be utilized to receive the mounting board bolt 2210.

Figure 23:
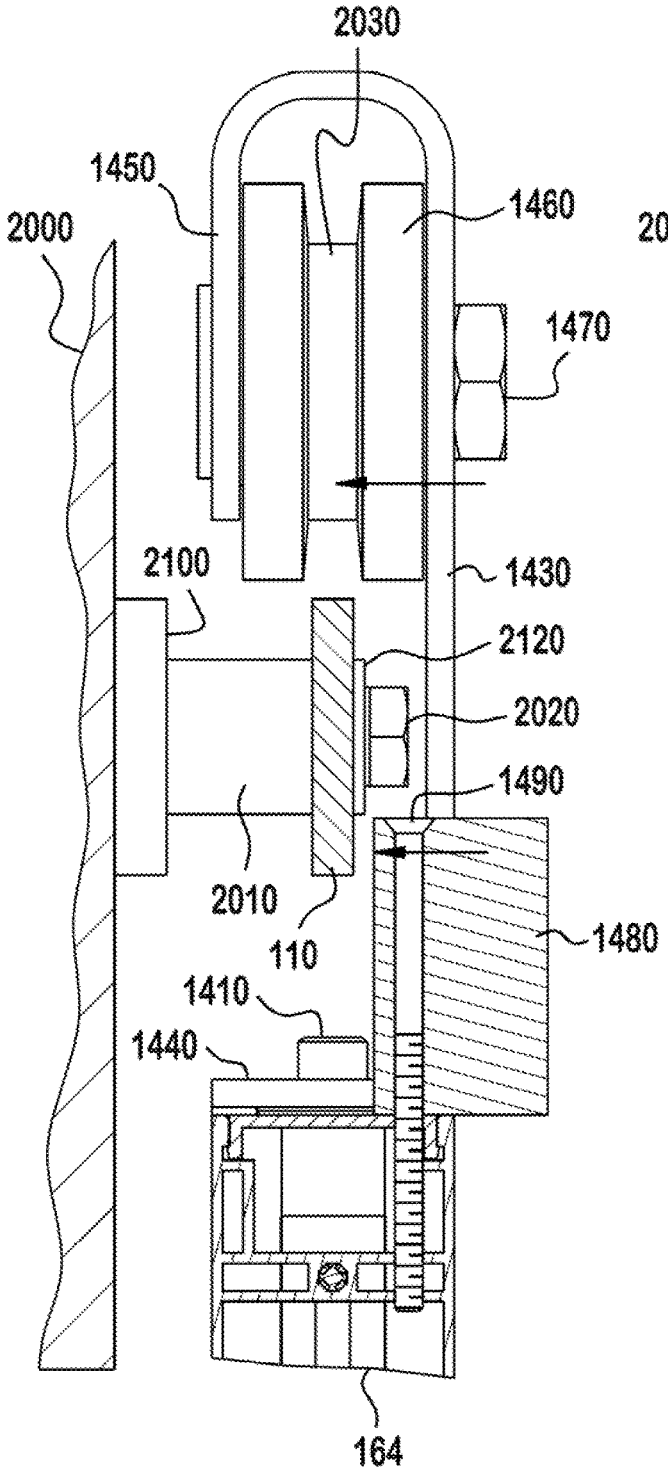
FIG. 23 illustrates a close up view of the safety spacer configuration prior to the door being placed on the track, according to one embodiment.
Figure 24:
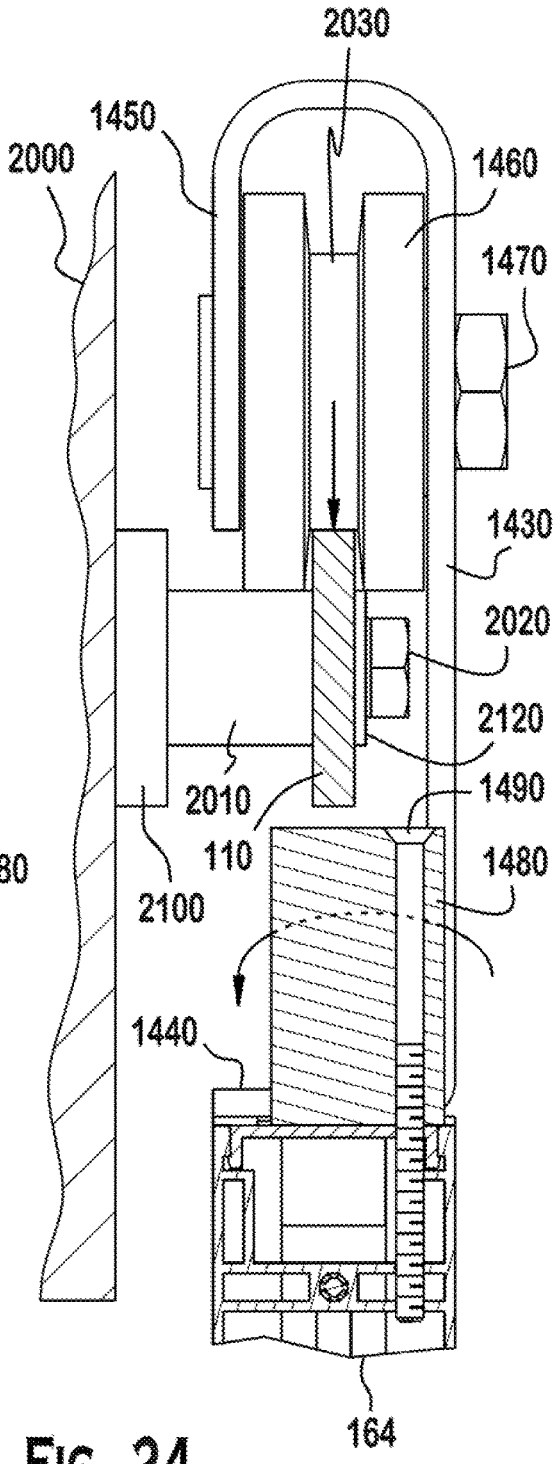
FIG. 24 illustrates a close up view of the safety spacer configuration after the door is placed on the track, according to one embodiment.

FIGS. 23 and 24 illustrate close up views of the safety spacer 1480 configuration prior to, and after, the door 130 (only the upper frame piece 164 is visible) is placed on the track 110. The safety spacer 1480 is secured to an upper edge of the upper frame piece 164. The safety spacer 1480 is internal to each roller bracket 120 on the door 130. It should be noted that the view is from the center of the door 130 looking out, so the safety spacer 1480 is in front of the roller bracket 120. Initially, the safety spacer 1480 is secured so that the safety spacer 1480 extends past the front edge of the door 130 (FIG. 23). The safety spacer 1480 is secured to the door 130 using a screw 1490. Once the door 130 is placed on the track 110, the safety spacer 1480 is rotated so that it is located on top of the door 130 and will prevent the door 130 from being raised too much as the safety spacer 1480 will hit the track 110. Raising the door 130 too high could result in the door 130 coming off the track 110. The purpose of rotating the safety spacer 1480 is so that the safety spacer 1480 is not in the way when the door 130 is being installed on, or removed from, the track.

Figure 25:
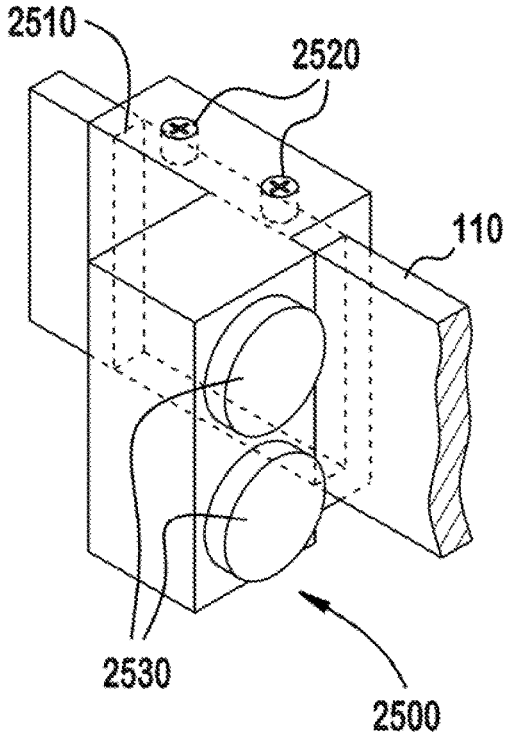
FIG. 25 illustrates a perspective view of a door stop used to prevent the door from sliding off the track, according to one embodiment.

FIG. 25 illustrates a perspective view of a door stop 2500 used to prevent the door 130 from sliding off the track 110. The door stop 2500 includes a passthrough groove 2510 formed therein for allowing the track 110 to pass therethrough (allowing door stop 2500 to be slid on the track 110). The door stop 2500 includes a position lock 2520 to secure the door stop 2500 to a particular location on the track 110. As illustrated, the position lock 2520 is a pair of set screws that can be tightened to hold the door stop 2500 to the track 110. The door stop 2500 is configured to extend away (substantially perpendicular) from the track 110 so as to interfere with (block) the main body 1430 of the roller bracket 120 from proceeding further along the track 110. The door stop 2500 may include an absorbent portion 2530 at a location that would contact the main body 1430 of the roller bracket 120 to prevent damage and/or turbulence.

Figure 26:
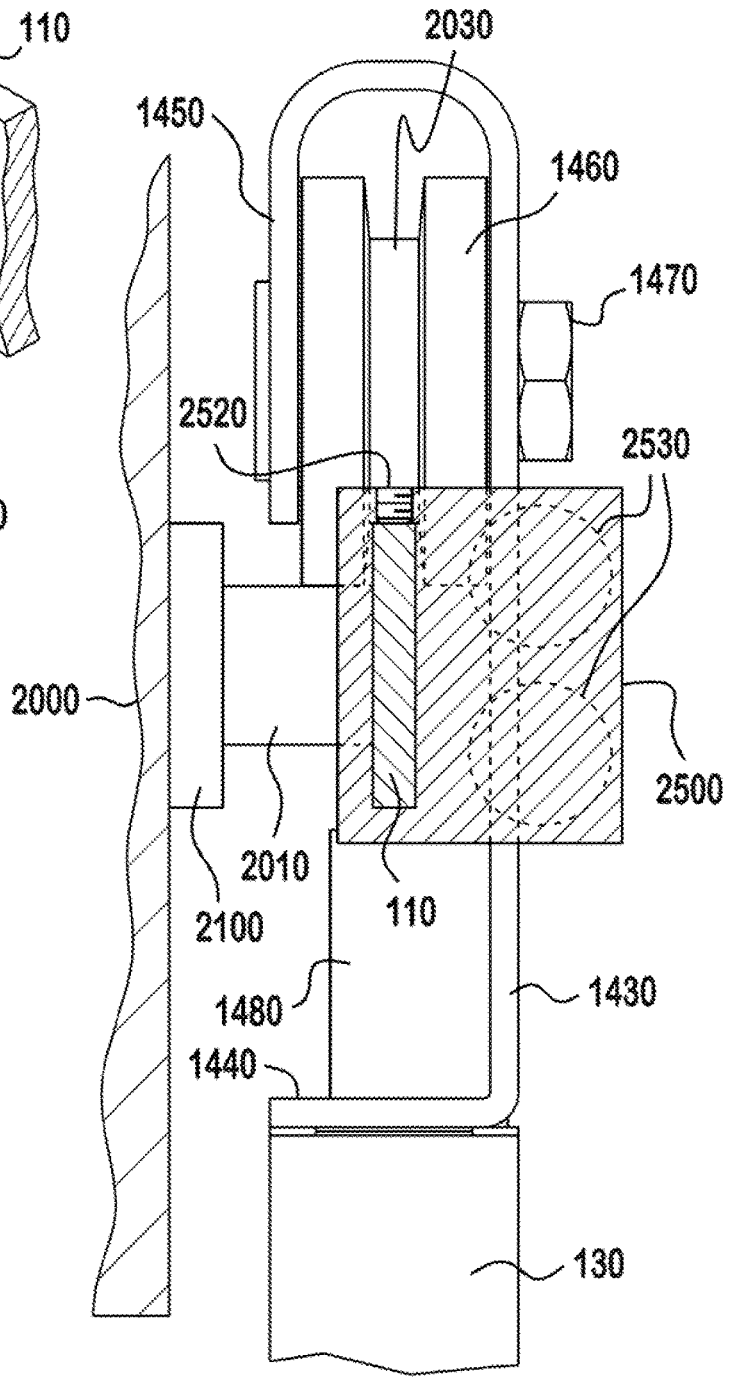
FIG. 26 illustrates a close up view of the door stop blocking the main body of the roller bracket, according to one embodiment.

FIG. 26 illustrates a close up view of the door stop 2500 blocking the main body 1430 of the roller bracket 120. The door stop 2500 is located on the track 110 and extends away from the wall 2000 and towards the front of the door 130. The door stop 2500 which is secured to the track 110 via the position lock 2520 prevents the roller bracket 120 from proceeding any further on the track 110 (being able to roll off the end of the track 110). The absorbent portion 2530 may contact the main body 1430 of the roller bracket 120.

Figure 27:
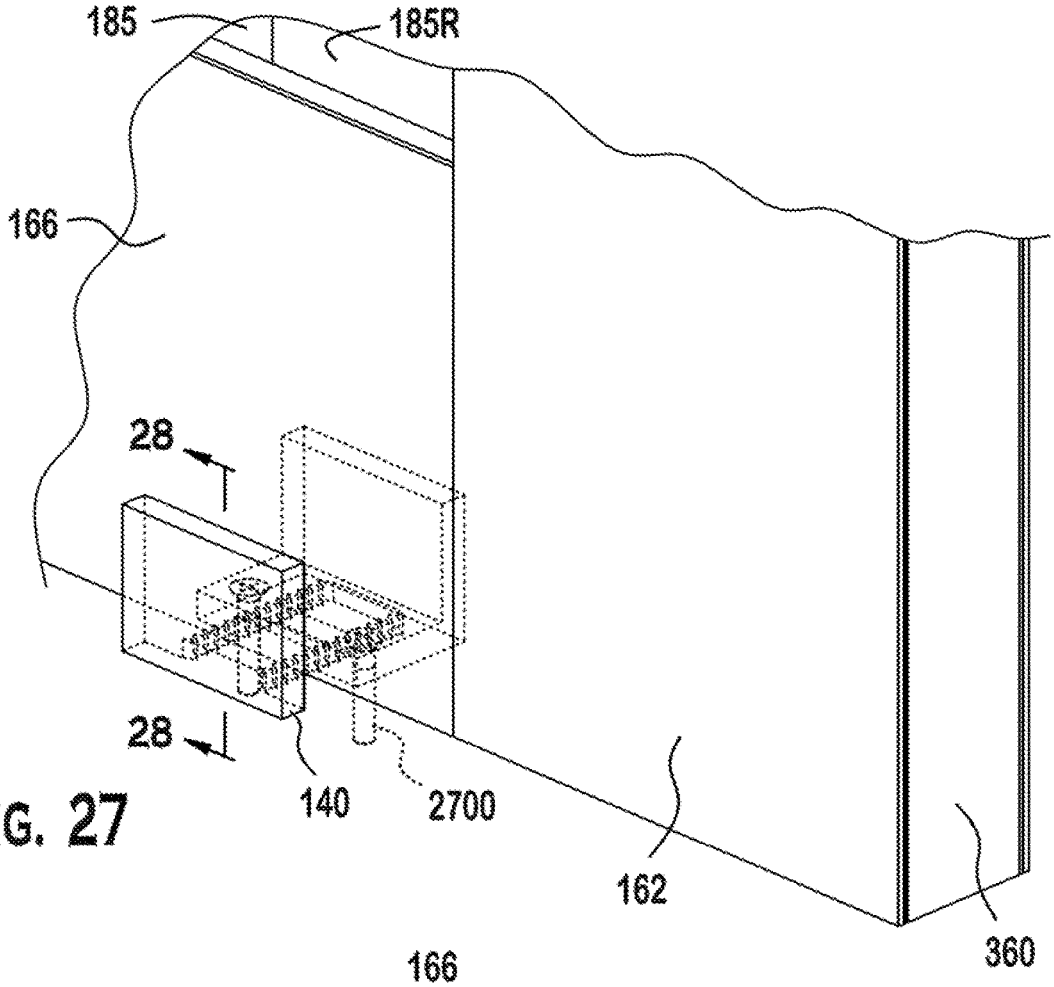
FIG. 27 illustrates a close up view of the floor guide being installed so as to support the door, according to one embodiment.

FIG. 27 illustrates a close up view of the floor guide 140 being installed so as to support the door 130 (prevent the bottom of the door 130 from swinging out from, or into, the wall). The floor guide 140 may be installed within the opening 150 on a side of the opening that the door 130 will extend past. For example, if the door 130 extends to the right of the opening 150 in an open configuration then the floor guide 140 will be installed on the right side of the opening 150. Accordingly, for the right side opening door, the floor guide 140 will support a left side of the door 130 in an open configuration and the right side in a closed configuration. The floor guide 140 may be U-shaped so that the door 130 can fit therewithin and prevent the bottom edge of the door 130 from swinging in either direction. The floor guide 140 may be secured to the floor using screws 2700.

According to one embodiment, the floor guide 140 may include two L-shaped pieces that are connected together to form a U. The two pieces may be capable of being connected together at various positions so that the size of the U can be configured. One of the L-shaped pieces may be configured to be received by the other L-shaped piece at different depths.

Figure 28:
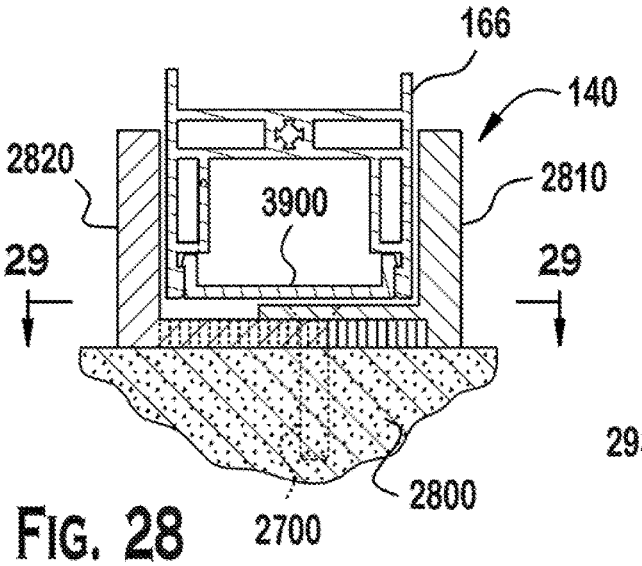
FIG. 28 illustrates a cross sectional view along section 28-28 of FIG. 27, according to one embodiment.

FIG. 28 illustrates a cross sectional view along section 28-28 of FIG. 27. As illustrated, the floor guide 140 is secured to the floor 2800 with screws 2700. The lower frame piece 166 is located within the floor guide 140. The floor guide 140 includes a first L-shaped piece 2810 and a second L-shaped piece 2820. The floor of the second L-shaped piece 2820 may be received within the floor of the first L-shaped piece 2810.

Figure 29:
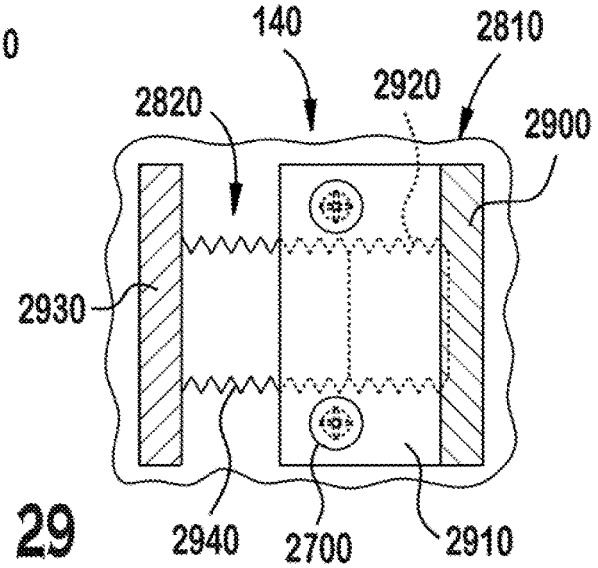
FIG. 29 illustrates a cross sectional view along section 29-29 of FIG. 28, according to one embodiment.

FIG. 29 illustrates a cross sectional view along section 29-29 of FIG. 28. As illustrated, the first L-shaped piece 2810 of the floor guide 140 includes a sidewall 2900 and a floor 2910. The floor 2910 includes holes formed therein for allowing the screws 2700 to be utilized to secure the floor guide 140 to the floor 2800. The second L-shaped piece 2820 of the floor guide 140 includes a sidewall 2930 and a floor 2940. The floor 2910 may include a groove 2920 formed therein. The floor 2940 may be narrower than the floor 2910 and approximately the same size as the groove 2920 so as to be received therewithin. The floors 2910, 2940 may be configured so the size of the U that is created by the two is configurable. According to one embodiment, the interior of the grove 2920 and the exterior of the floor 2940 may have jagged edges that allow the floors 2910, 2940 to be secured together in various configurations.

Figure 30:
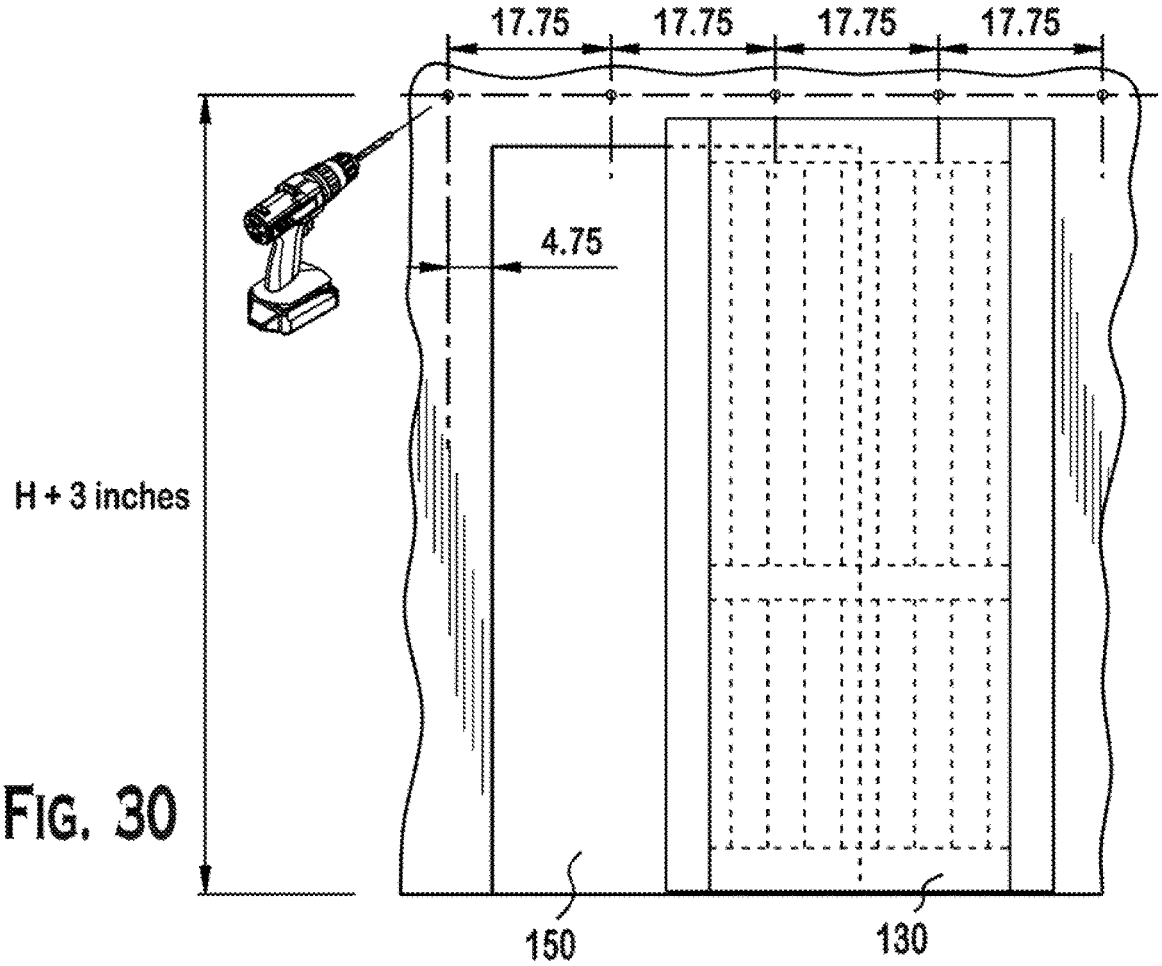
FIG. 30 illustrates the marking and drilling of holes in the wall in order to secure the track to the wall at the appropriate location for operating the door, according to one embodiment.

FIGS. 30-46 illustrate the installation and assembly of the barn door system 100. FIG. 30 illustrates the marking and drilling of holes in the wall in order to secure the track 110 to the wall at the appropriate location for operating the door 130. As illustrated, the holes are marked 3 inches above the height of the opening 150 and start 4.75 inches outside the opening 150 and then are added every 17.75 inches from there. It should be noted the dimensions are in no way intended to be limited thereto. Rather the dimensions may vary based on different parameters including, but not limited to, the size of the opening 150, door 130 and/or track 110.

Figure 31:
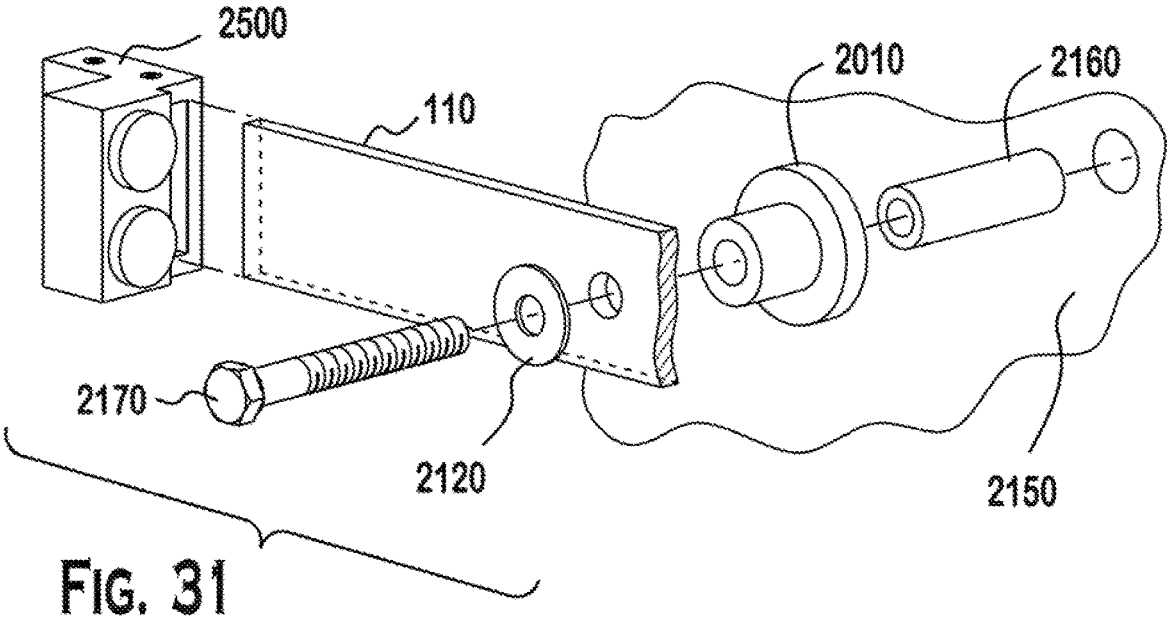
FIG. 31 illustrates the securing of the track to a masonry wall, according to one embodiment.

FIG. 31 illustrates the securing of the track 110 to a masonry wall 2150. After the hole is drilled in the masonry wall 2150 an anchor 2160 is secured therein. The masonry bolt 2170 is then passed through the washer 2120, the hole in the track 110, and the spacer 2010 and is secured within the anchor 2160. The door stop 2500 is placed on the track 110.

Figure 32:
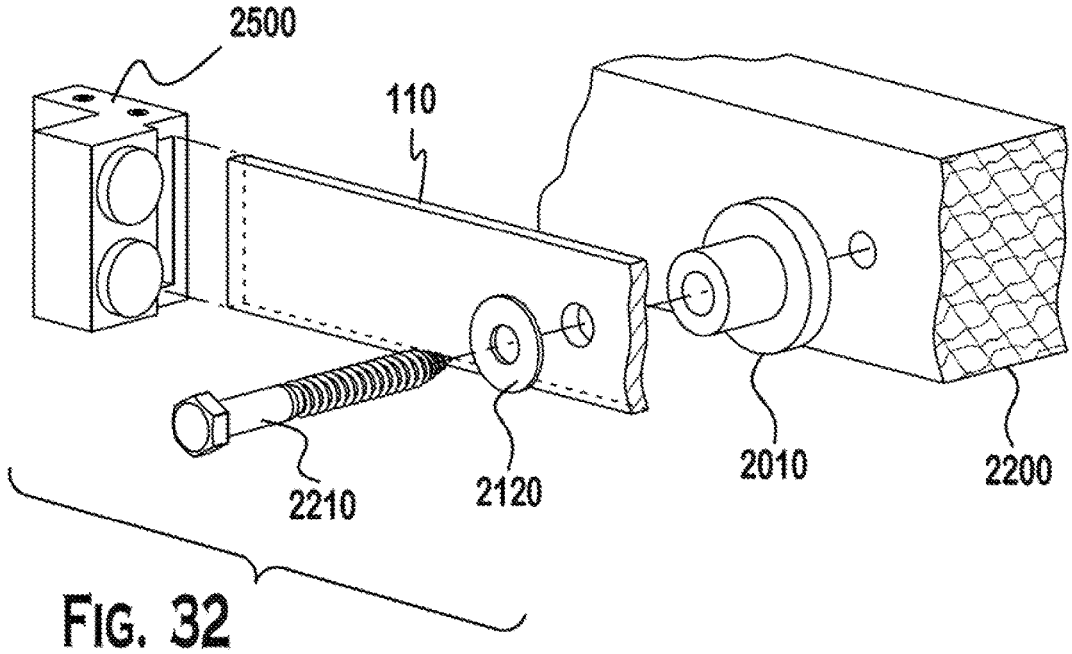
FIG. 32 illustrates the securing of the track to a stud behind the mounting board wall, according to one embodiment.

FIG. 32 illustrates the securing of the track 110 to a stud 2200 behind the mounting board wall. After the hole is drilled in the mounting board wall and the stud 2200, the mounting board bolt 2210 is then passed through the washer 2120, the hole in the track 110, and the spacer 2010 and is secured to the stud 2200. The door stop 2500 is placed on the track 110.

Figure 33:
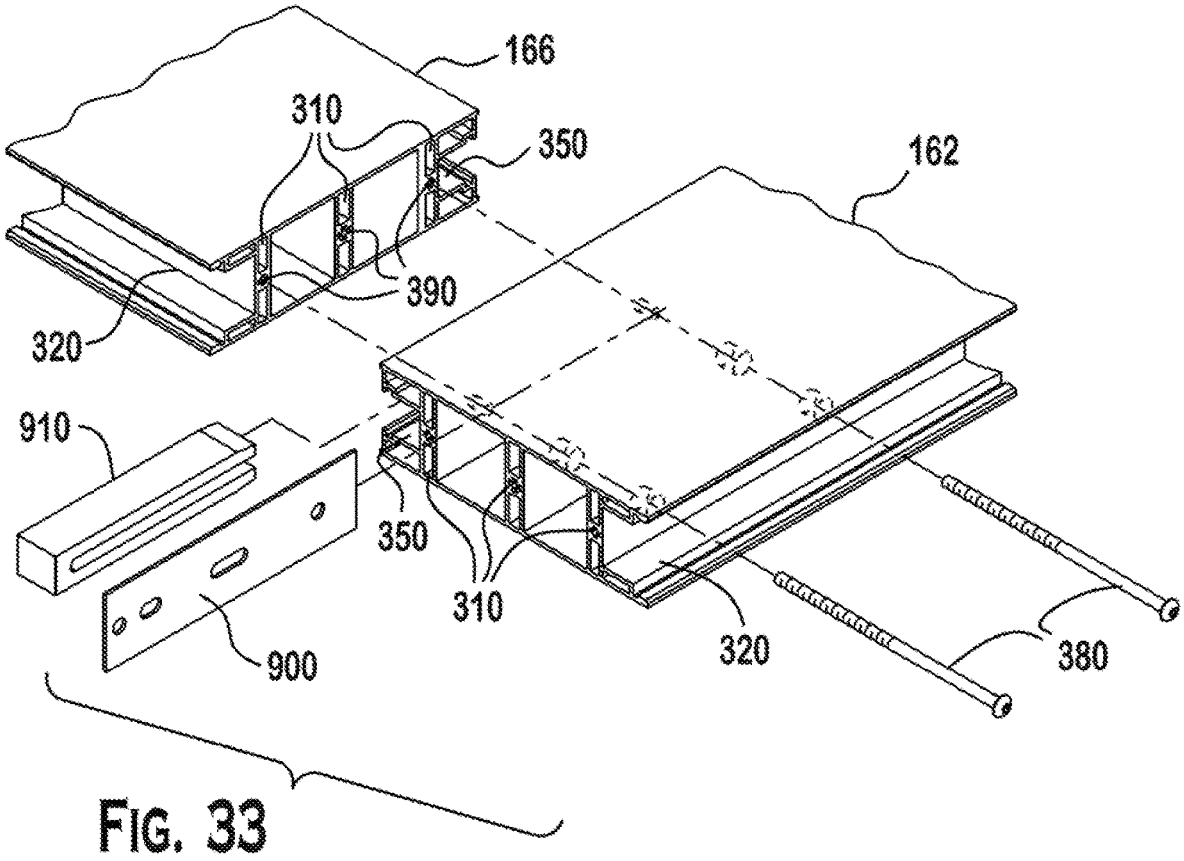
FIG. 33 illustrates the right frame piece and the lower frame piece being connected, according to one embodiment.

FIG. 33 illustrates the right frame piece 162 and the lower frame piece 166 being connected. The supports 310 and the screw taps 315 are visible in the right frame piece 162 and the supports 310 and the screw taps 390 are visible in the lower frame piece 166. The right frame piece 162 is configured so the external section 320 faces rightward, away from the lower frame piece 166, so as to be external to the door 130 and the internal section 350 faces leftward, toward the lower frame piece 166, so as to be internal to the door 130 (left channel). The lower frame piece 166 is configured so the external section 320 faces downward so as to be external to the door 130 and the internal section 350 faces upward so as to be internal to the door 130 (upper channel).

The support plate 900 is placed within the center section 340 of the right frame piece 162 and the support piece 910 is placed within the interior section 350. The right frame piece 162 and the lower frame piece 166 are then secured with screws 380. The screws 380 pass through the holes 400 in the supports 310 of the right frame piece 162. The threads of the screw 380 further pass through the support plate 900, the support 310 and the support piece 910 and enter the screw taps 390 of the lower frame piece 166.

Figure 34:
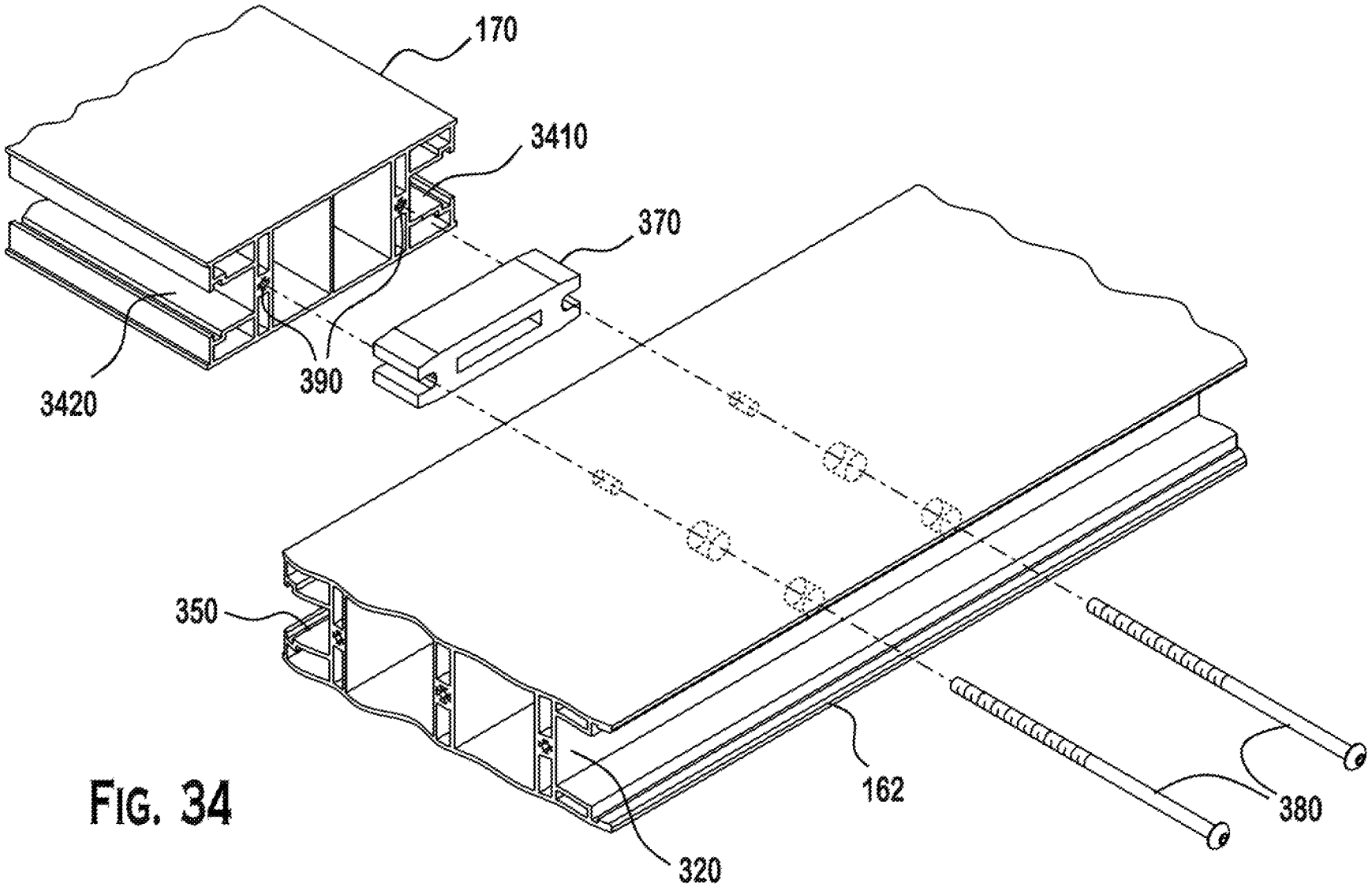
FIG. 34 illustrates the right frame piece and the center frame piece being connected, according to one embodiment.

FIG. 34 illustrates the right frame piece 162 and the center frame piece 170 being connected. As noted above with respect to FIG. 33, the right frame piece 162 is configured so the external section 320 is external to the door 130 and the internal section 350 is internal to the door 130. The center frame piece 170 includes upper and lower channels 3410, 3420 that are configured the same as the internal section 350 of the exterior frame pieces 160, 162, 164, 166. The support piece 370 is placed within the interior section 350 of the right frame piece 162. The right frame piece 162 and the center frame piece 170 are then secured with screws 380. The screws 380 pass through the holes 400 in the supports 310 of the right frame piece 162. The threads of the screw 380 further pass through the support 310 and the support piece 370 and enter the screw taps 390 of the center frame piece 170.

Figure 35:
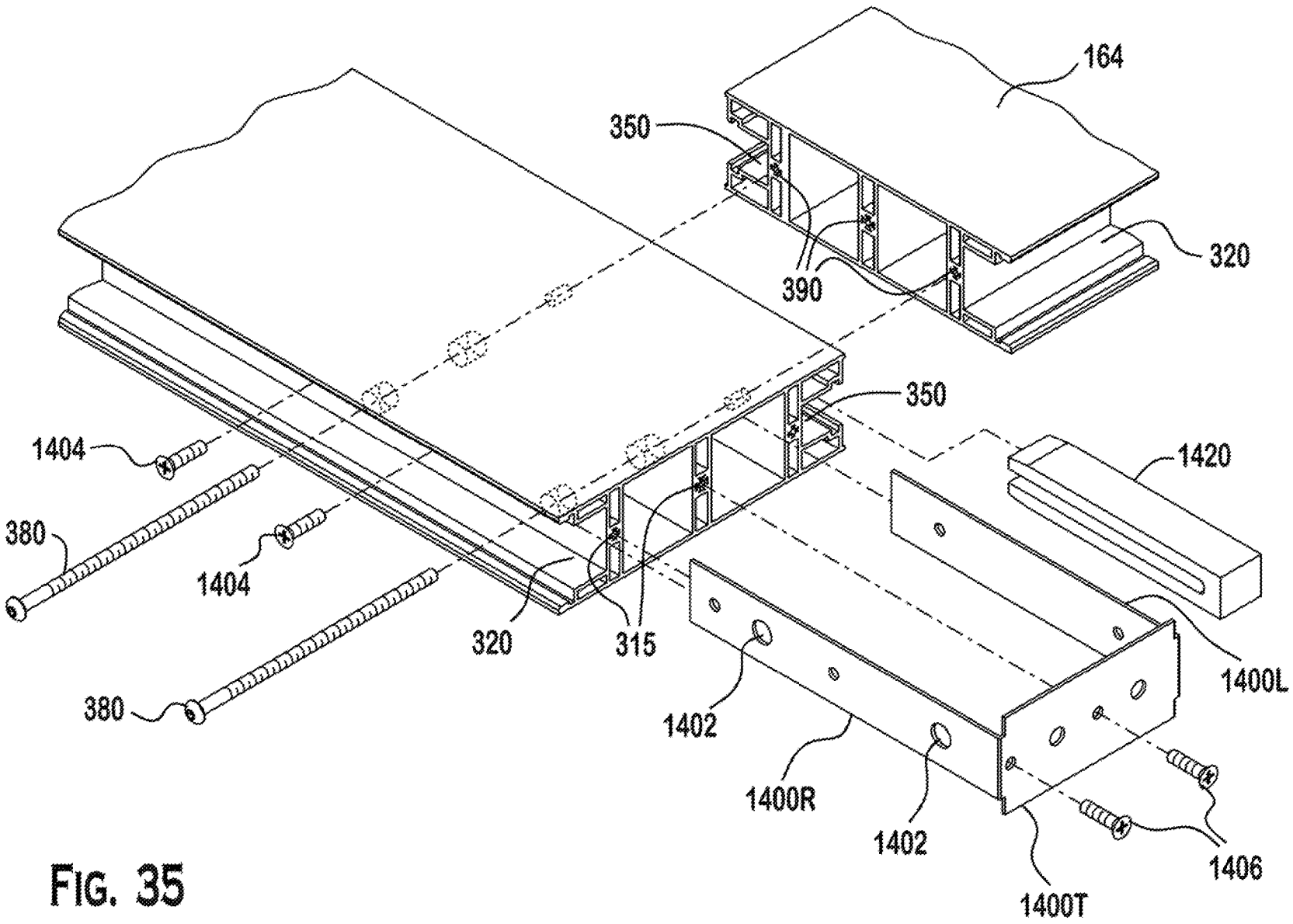
FIG. 35 illustrates the right frame piece and the upper frame piece being connected, according to one embodiment.

FIG. 35 illustrates the right frame piece 162 and the upper frame piece 164 being connected. The upper frame piece 164 is configured so the external section 320 faces upward so as to be external to the door 130 and the internal section 350 faces downward so as to be internal to the door 130 (lower channel). The right leg of the support plate 1400R is placed within the exterior section 320 of the right frame piece 162, the left leg of the support plate 1400L is placed with the center section 340 and the top of the support plate 1400T rests on top of the right frame piece 162. The right leg 1400R is secured to the support 310 with screws 1404 and the top 1400T is secured with screws 1406 being secured into the screw taps 315. The support piece 1420 is placed within the interior section 350. The right frame piece 162 and the upper frame piece 164 are then secured with screws 380. The screws 380 pass through the holes 400 in the supports 310 of the right frame piece 162 and the right leg 1400R. The threads of the screw 380 further pass through the left leg 1400L, the support 310 and the support piece 1420 and enter the screw taps 390 of the upper frame piece 164.

Figure 36:
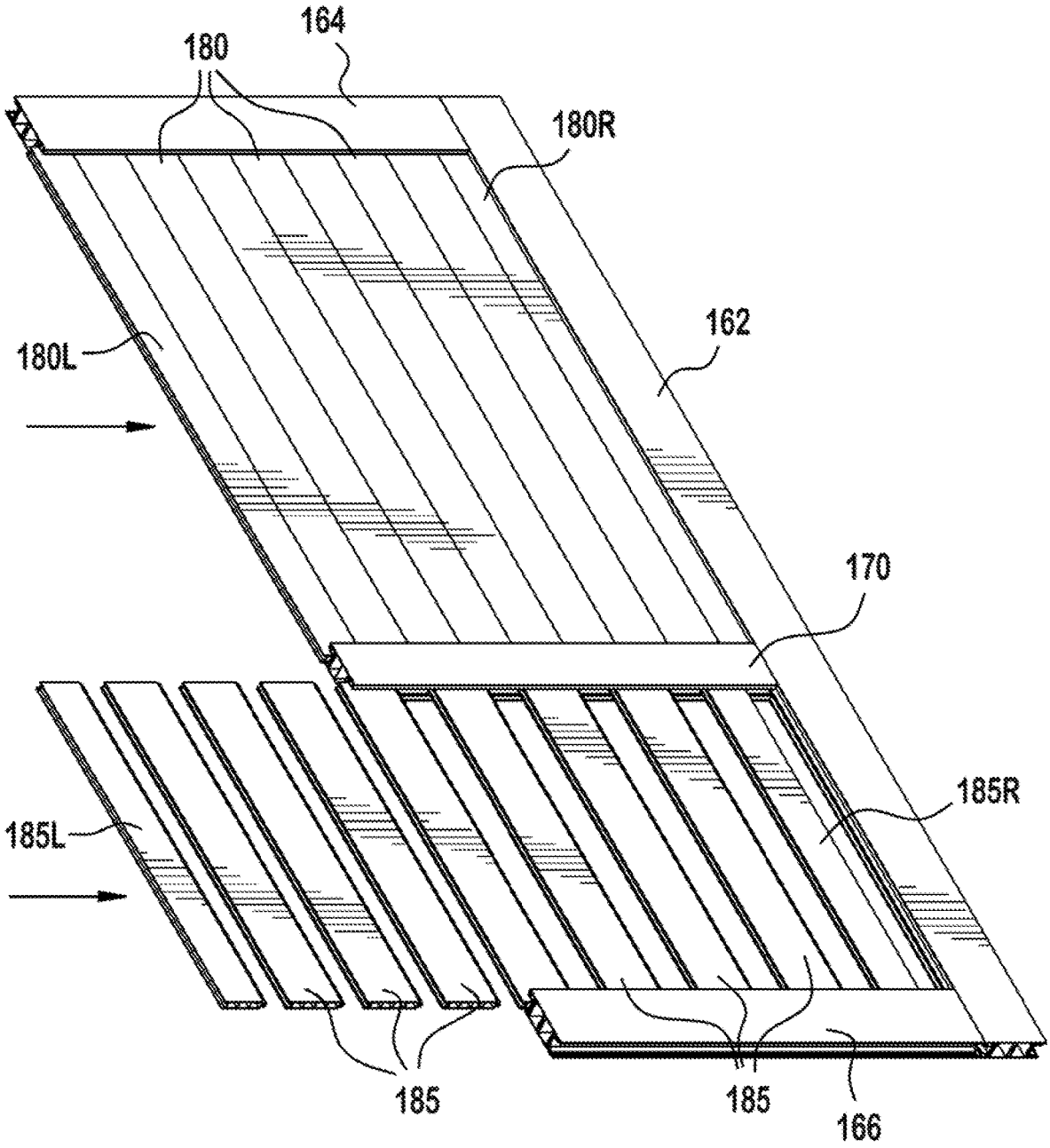
FIG. 36 illustrates installation of the plurality of upper and lower vertical panels, according to one embodiment.

FIG. 36 illustrates installation of the plurality of upper and lower vertical panels 180, 185. The plurality of upper vertical panels 180 have been installed between the upper frame piece 164 and the center frame piece 170 and the plurality of the lower vertical panels 185 are being installed between the center frame piece 170 and the lower frame piece 166. The upper vertical panels 180 are installed so that a top side is received within a lower channel 350 (interior section) of the upper frame piece 164 and a bottom side is received within an upper channel 3410 of the center frame piece 170. The lower vertical panels 185 are installed so that a top side is received within a lower channel 3420 of the center frame piece 170 and a bottom side is received within an upper channel 350 (interior section) of the lower frame piece 166.

The vertical panels 180, 185 include a tongue on one side and a grove on the other side so that the pieces 180, 185 can be connected together. According to one embodiment, the rightmost vertical panels 180R, 185R do not include a tongue/groove on the right side so that they can be received within the left channel 350 (interior section) of the right frame piece 162 (are installed first). Likewise, the leftmost vertical panels 180L, 185L do not include a tongue/groove on the left side so that they can be received within the right channel 350 (interior section) of the left frame piece 160 (are installed last).

Figure 37:
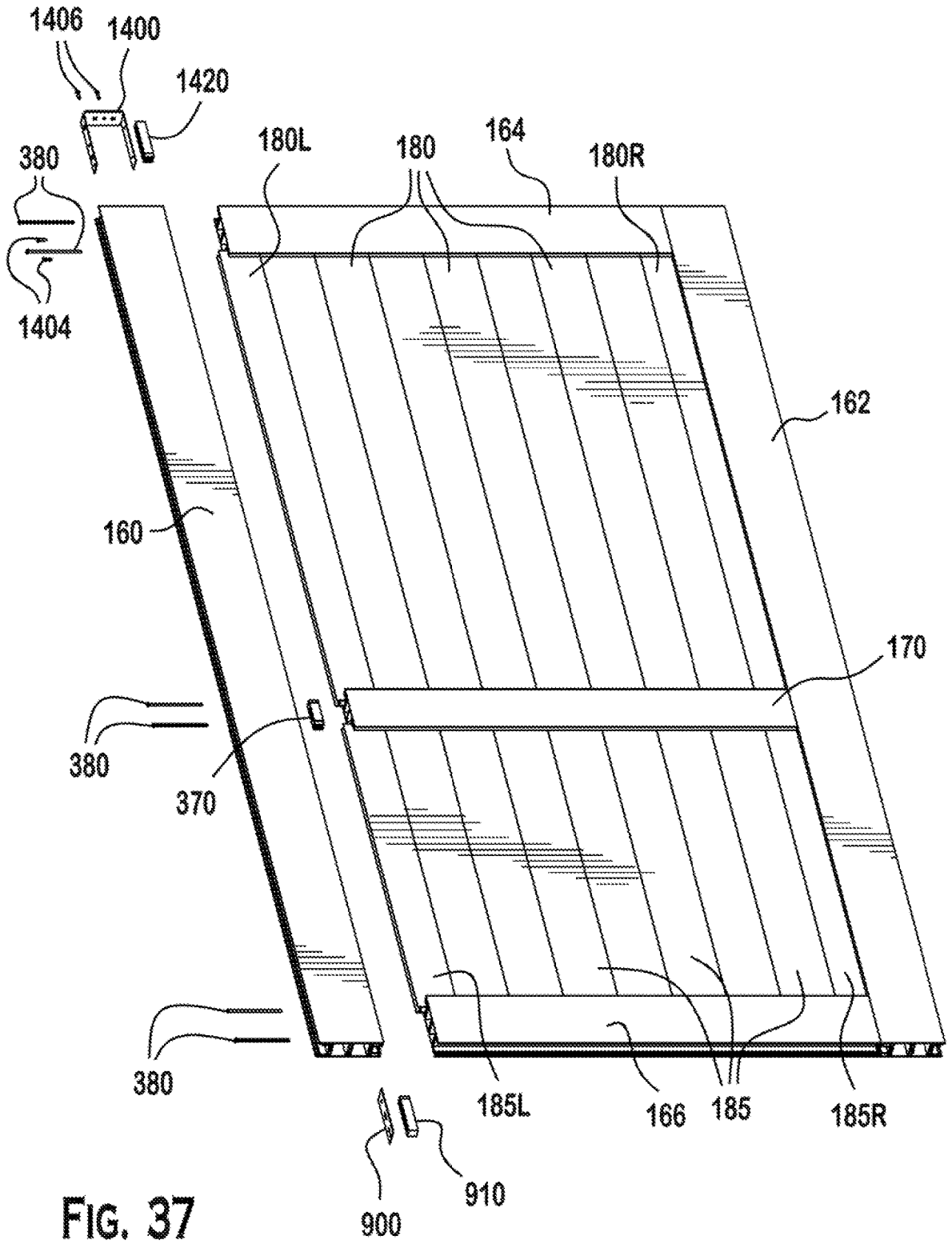
FIG. 37 illustrates the installation of the left frame post onto the door, according to one embodiment.

FIG. 37 illustrates the installation of the left frame piece 160 onto the door 130. The left frame piece 160 is configured so the external section 320 faces leftward, away from the upper, lower and center frame pieces 164, 166, 170, so as to be external to the door 130 and the internal section 350 faces rightward, toward the upper, lower and center frame pieces 164, 166, 170, so as to be internal to the door 130 (right channel). The support bracket 1400 and the support piece 1420 are installed on an upper edge of the left frame piece 160 to assist with the connection of the left frame piece 160 and the upper frame piece 164. The support piece 370 is installed in the center of the left frame piece 160 to assist with the connection of the left frame piece 160 and the center frame piece 170. The support bracket 900 and the support piece 910 are installed on a lower edge of the left frame piece 160 to assist with the connection of the left frame post 160 and the lower frame post 166.

Figure 38:
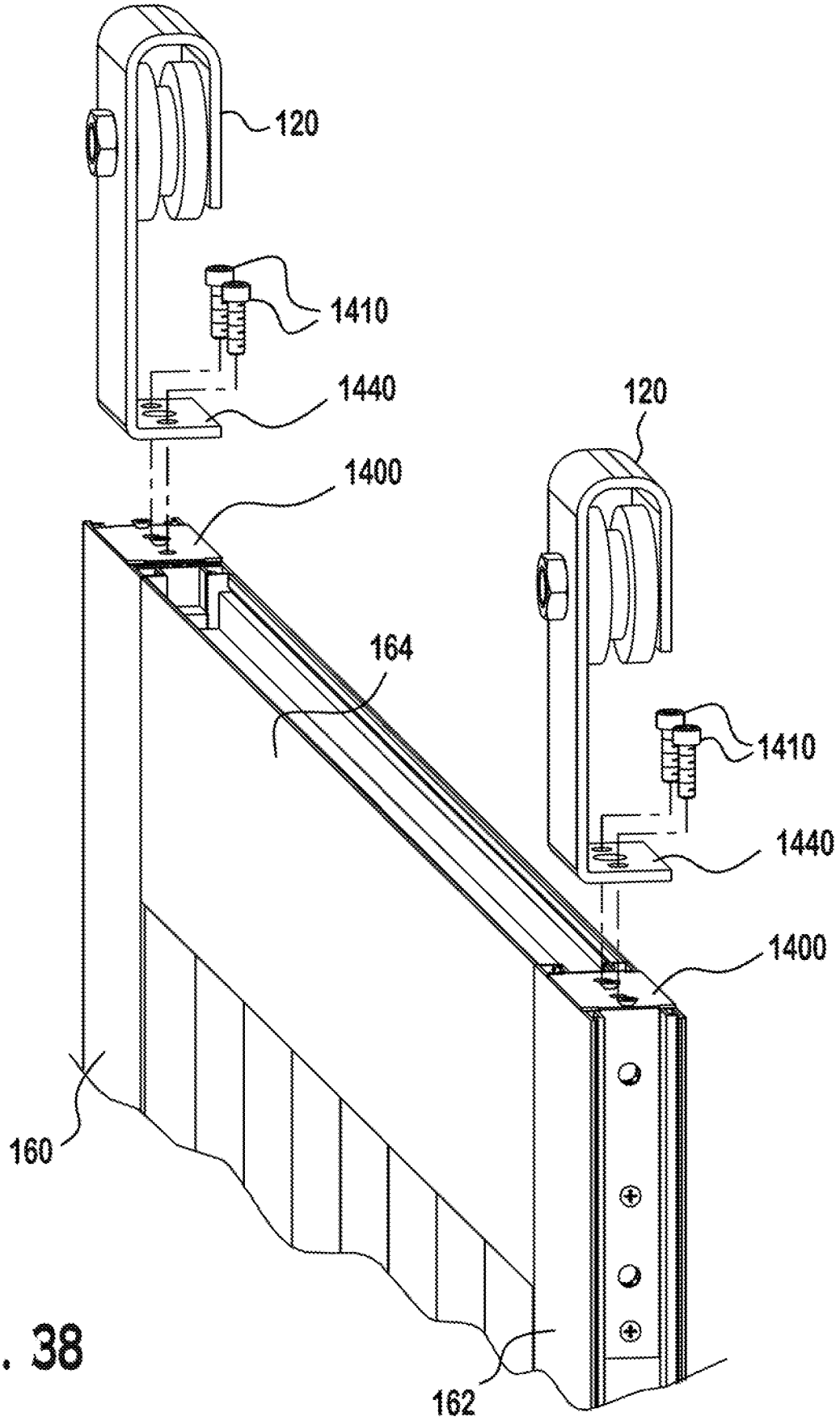
FIG. 38 illustrates the connection of the roller brackets to the top of the support brackets on the left and right frame posts, according to one embodiment.

FIG. 38 illustrates the connection of the roller brackets 120 to the top of the support brackets 1400T on the left and right frame pieces 160, 162. The roller brackets 120 are secured by threading the screws 1410 through the holes in the roller brackets 120 and into the threaded holes 1408 in the tops of the support brackets 1400T.

Figure 39:
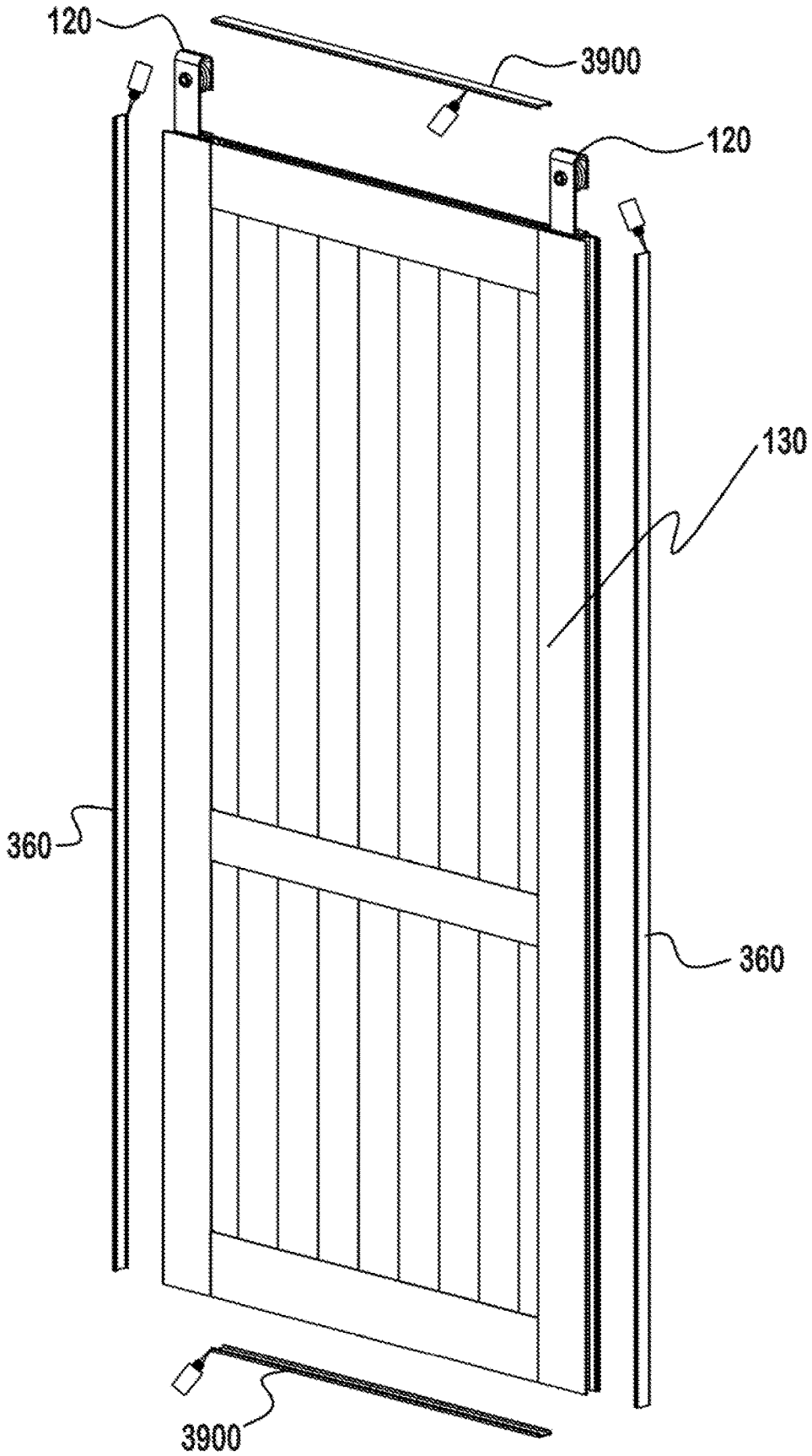
FIG. 39 illustrates the installation of the caps along the edges of the door to provide a finished look, according to one embodiment.

FIG. 39 illustrates the installation of the caps along the edges of the door 130 to provide a finished look. The left and right caps 360 are installed in the exterior channels of the left and right frame pieces 160, 162 and upper and lower caps 3900 are installed in the upper/lower channels respectively of the upper and lower frame pieces 164, 166. The caps 360, 3900 may be secured therein with glue.

Figure 40:
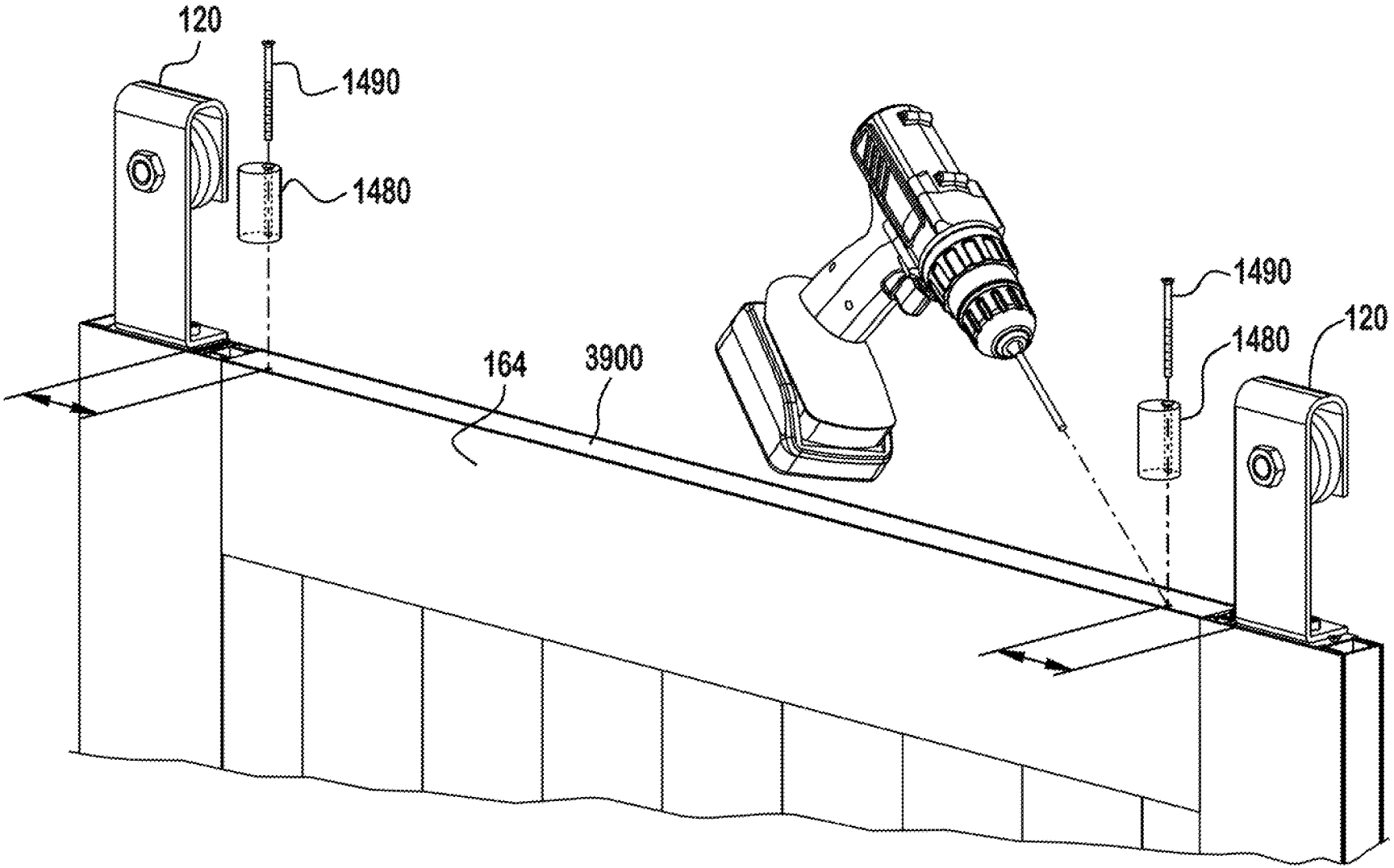
FIG. 40 illustrates the installation of the safety spacers along an upper edge of the door, according to one embodiment.

FIG. 40 illustrates the installation of the safety spacers 1480 along an upper edge of the door 130. The safety spacers 1480 are secured to the upper frame piece 164 a certain distance inside of the roller brackets 120. The safety spacers 1480 are screwed into the upper frame piece 164 through the upper cap 3900.

Figure 41:
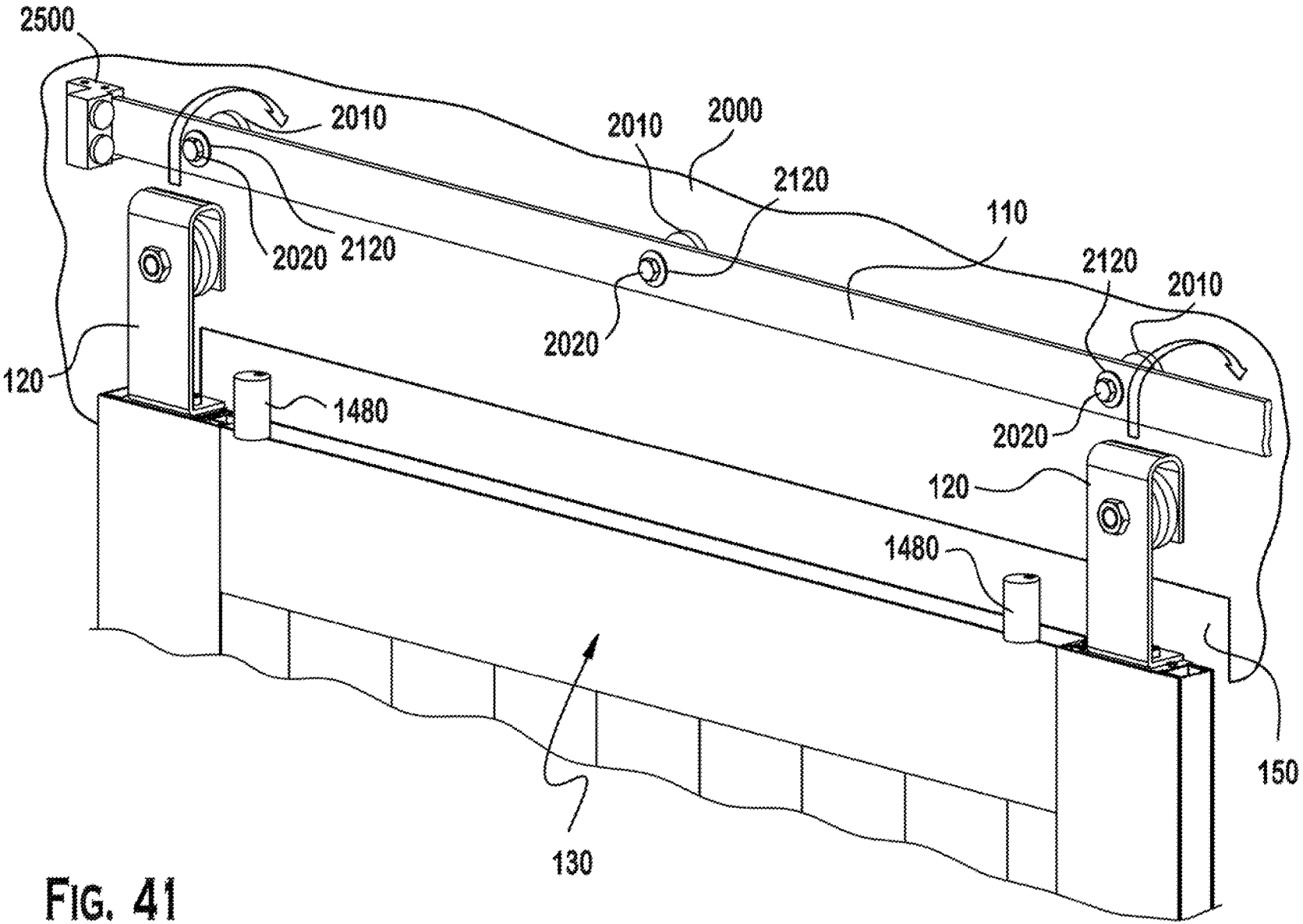
FIG. 41 illustrates the installation of the door onto the track, according to one embodiment.

FIG. 41 illustrates the installation of the door 130 onto the track 110. The door 130 is installed by lifting the roller brackets 120 above the track 110 and then pushing the roller brackets 120 back so the wheel 1460 is above the track 110 with the groove 2030 aligned with the track 110. The roller brackets 120 are then lowered so that the track 110 is within the groove 2030.

Figure 42:
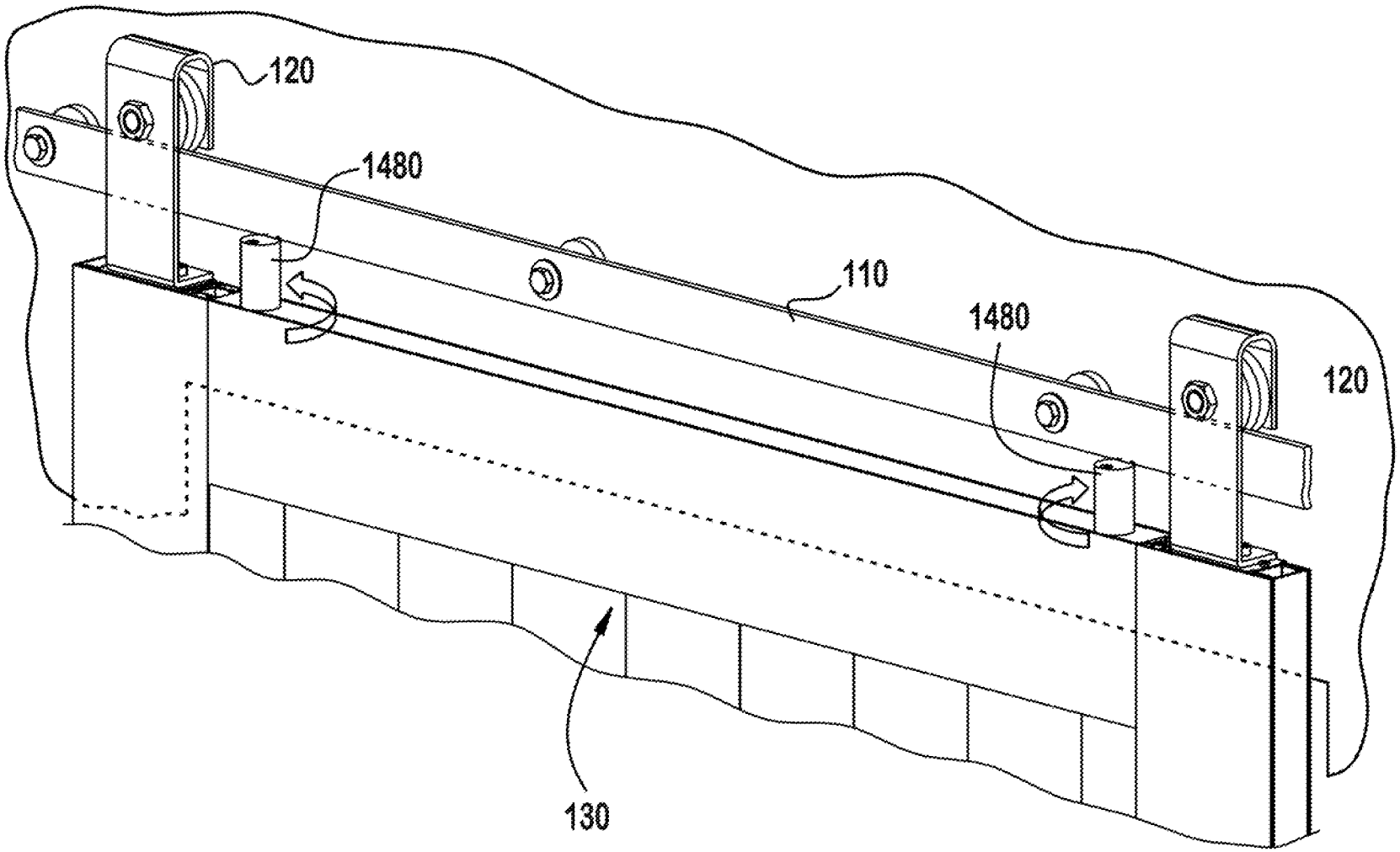
FIG. 42 illustrates the safety spacers being rotated into place after the door has been installed on the track, according to one embodiment.

FIG. 42 illustrates the safety spacers 1480 being rotated into place after the door 130 has been installed on the track 110. The safety spacers 1480 prevent the door 130 from coming off the track 110.

Figure 43:
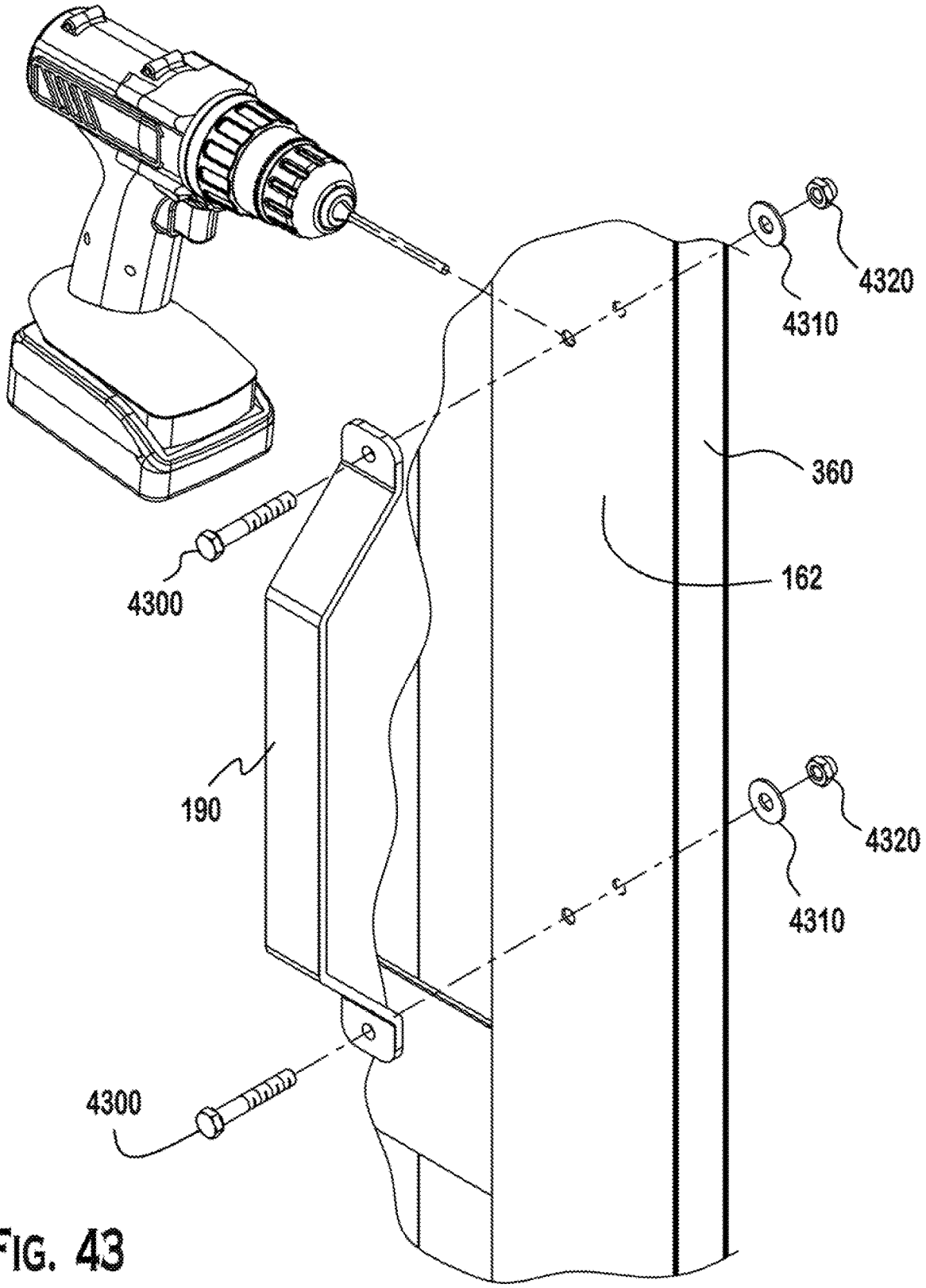
FIG. 43 illustrates the installation of the handle onto the door, according to one embodiment.

FIG. 43 illustrates the installation of the handle 190 onto the door 130. As illustrated, the handle 190 is being installed on the right frame piece 162 for a right handed door. The door is in no way intended to be limited to a right handed door. The handle 190 is aligned at an appropriate location on the door 130 (right frame piece 162) and guide holes are drilled therethrough. The handle 190 is then secured by running bolts through the handle 190 and the holes formed in the right frame piece 162 and securing washers 4310 and nuts 4320 on the bolts 4300.

Figure 44:
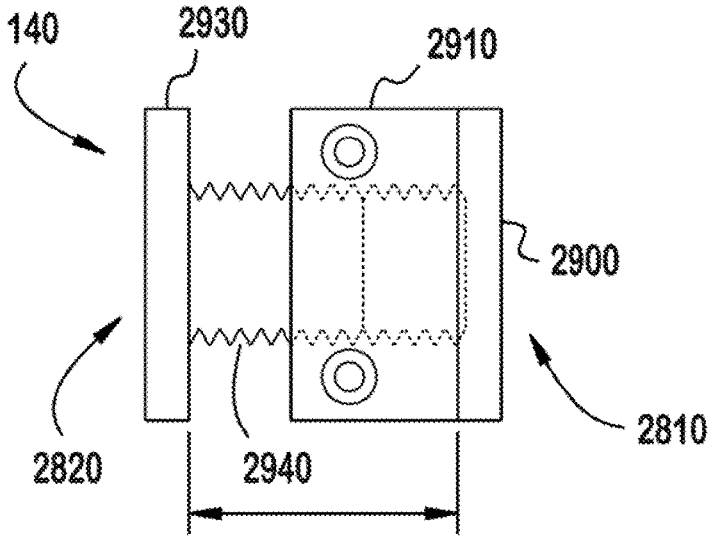
FIG. 44 illustrates the configuring of the floor guide to the appropriate size for the door, according to one embodiment.

FIG. 44 illustrates the configuring of the floor guide 140 to the appropriate size for the door 130. The floor 2940 of the second L-shaped bracket 2820 is secured within the floor 2910 of the first L-shaped bracket 2810 at an appropriate location so that the sidewalls 2900, 2930 are an appropriate distance apart.

Figure 45:
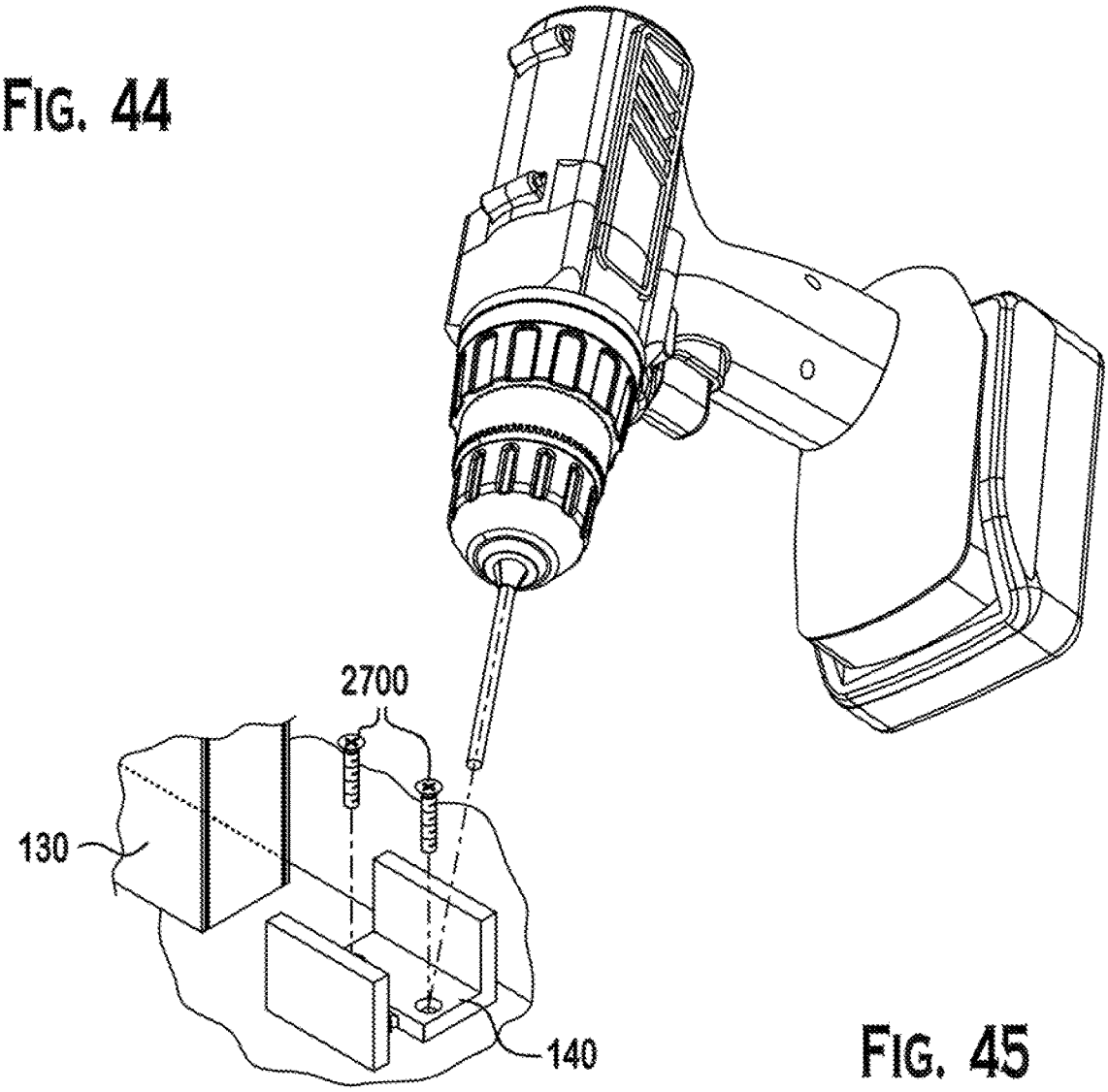
FIG. 45 illustrates the floor guide being secured at an appropriate location on the floor using screws, according to one embodiment.

FIG. 45 illustrates the floor guide 140 being secured at an appropriate location on the floor using screws 2700. The floor guide 140 should be secured to the floor so that the door 130 will be secured therein in either the open or closed configuration.

Figure 46:
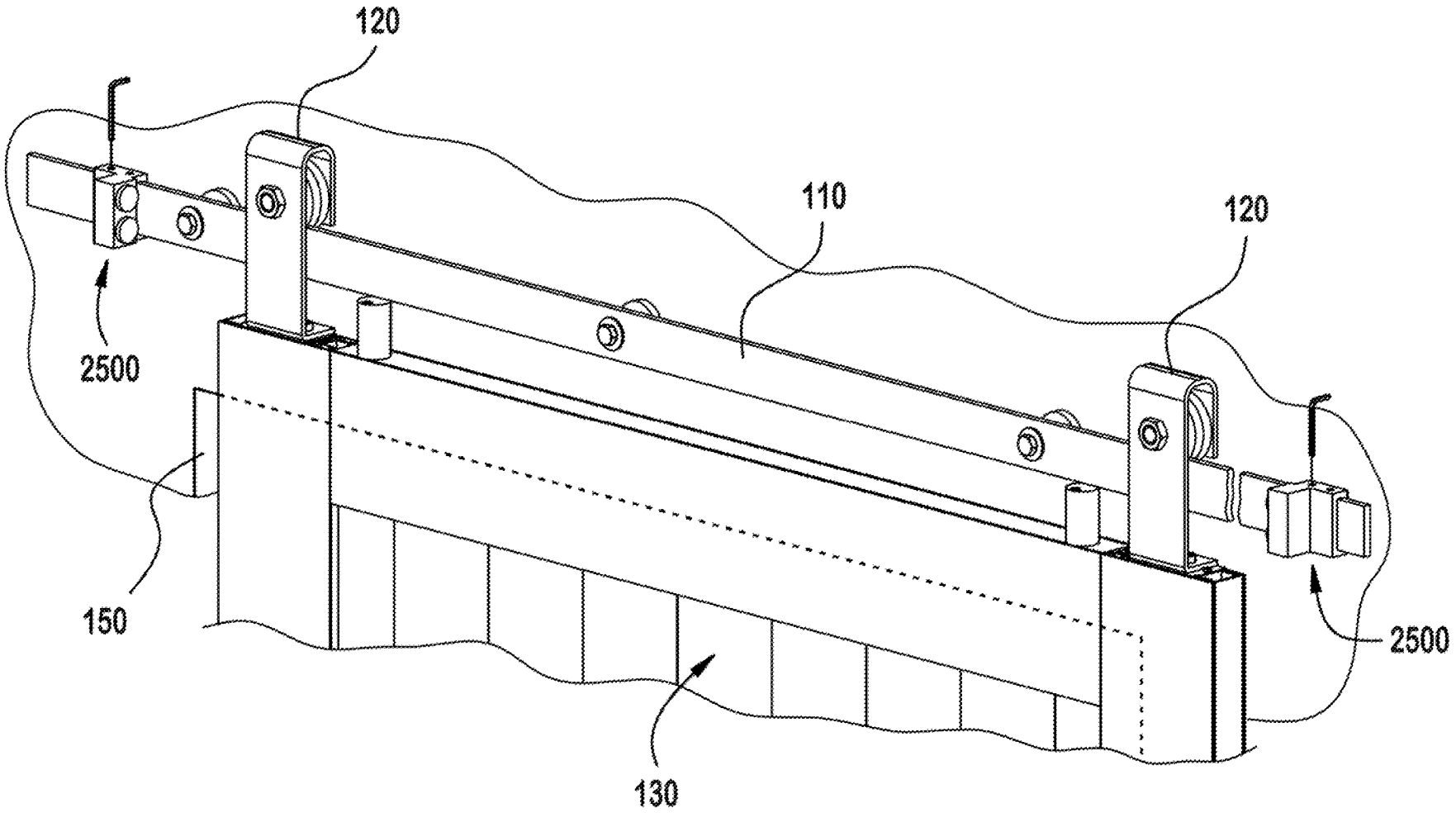
FIG. 46 illustrates the securing of the door stops to the bar, according to one embodiment.

FIG. 46 illustrates the securing of the door stops 2500 to the bar 110. The door stops 2500 are secured outside of the roller arms 120 and the last mount securing the bar 110 to the wall. The door stops 2500 are secured by tightening the set screws so that they engage the track 110.

Figure 47:
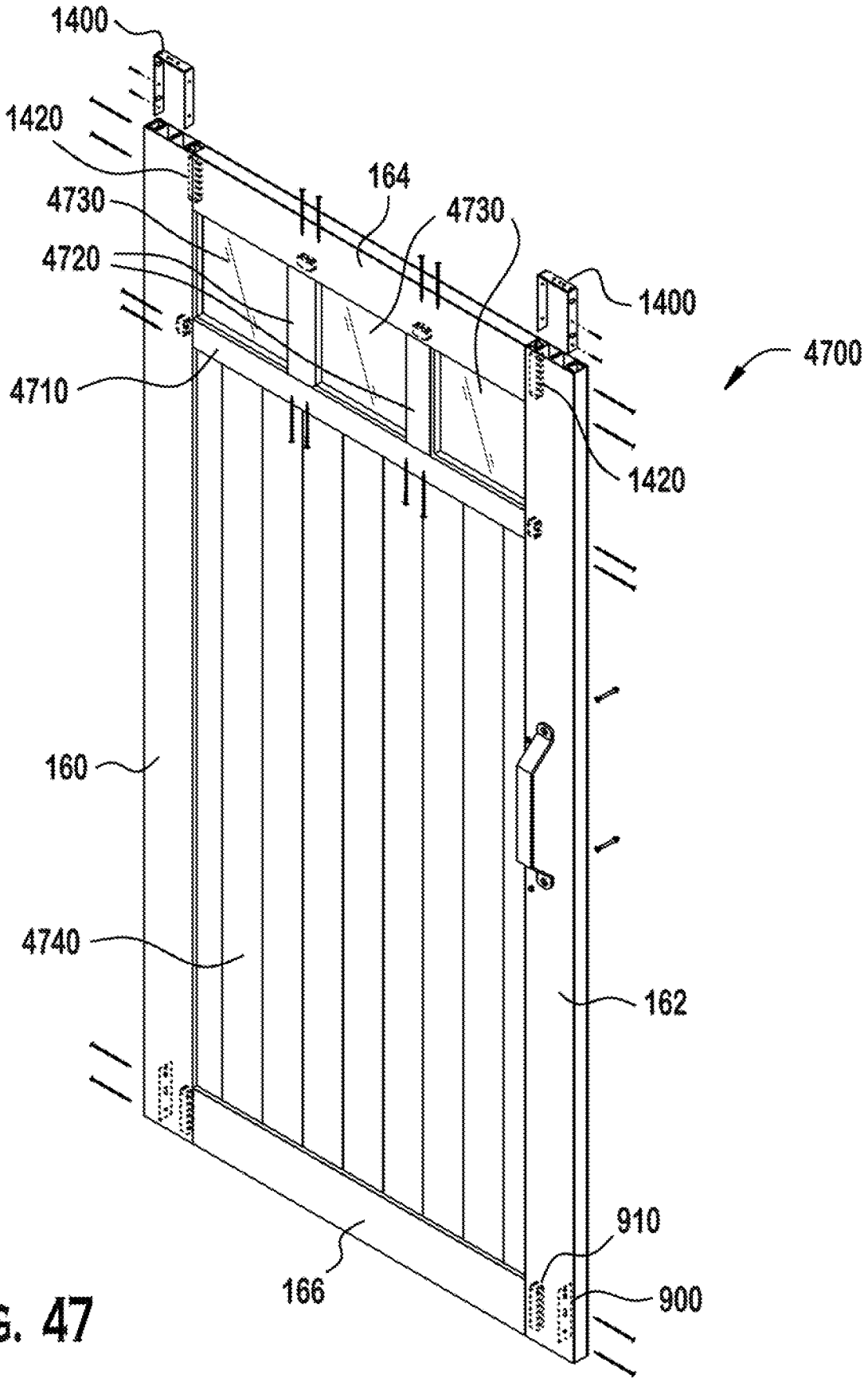
FIG. 47 illustrates a perspective view of an alternative barn door that is part of a barn door kit, according to one embodiment.

FIG. 47 illustrates a perspective view of an alternative barn door 4700 that is part of a barn door kit. The pieces making up the barn door 4700 may include the same frame pieces 160, 162, 164, 166 as the door 130. The frame pieces may be connected in a similar fashion as described above with respect to the door 130 including the use of the brackets 900, support piece 910, brackets 1400 and support pieces 1420. The door 4700 may include a cross bar 4710 in close proximity to the upper frame piece 164. Dividers 4720 may be inserted between the cross bar 4710 and the upper frame piece 164 to create a few open sections or windows 4730. The cross bar 4710 and the upper frame piece 164 may have holes formed therein to enable screws to pass therethrough to secure them to the dividers 4720. A plurality of longer vertical panels 4740 may be inserted between the cross bar 4710 and the lower frame piece 166 in similar fashion to the vertical panels 180, 185 of door 130.

Figure 48:
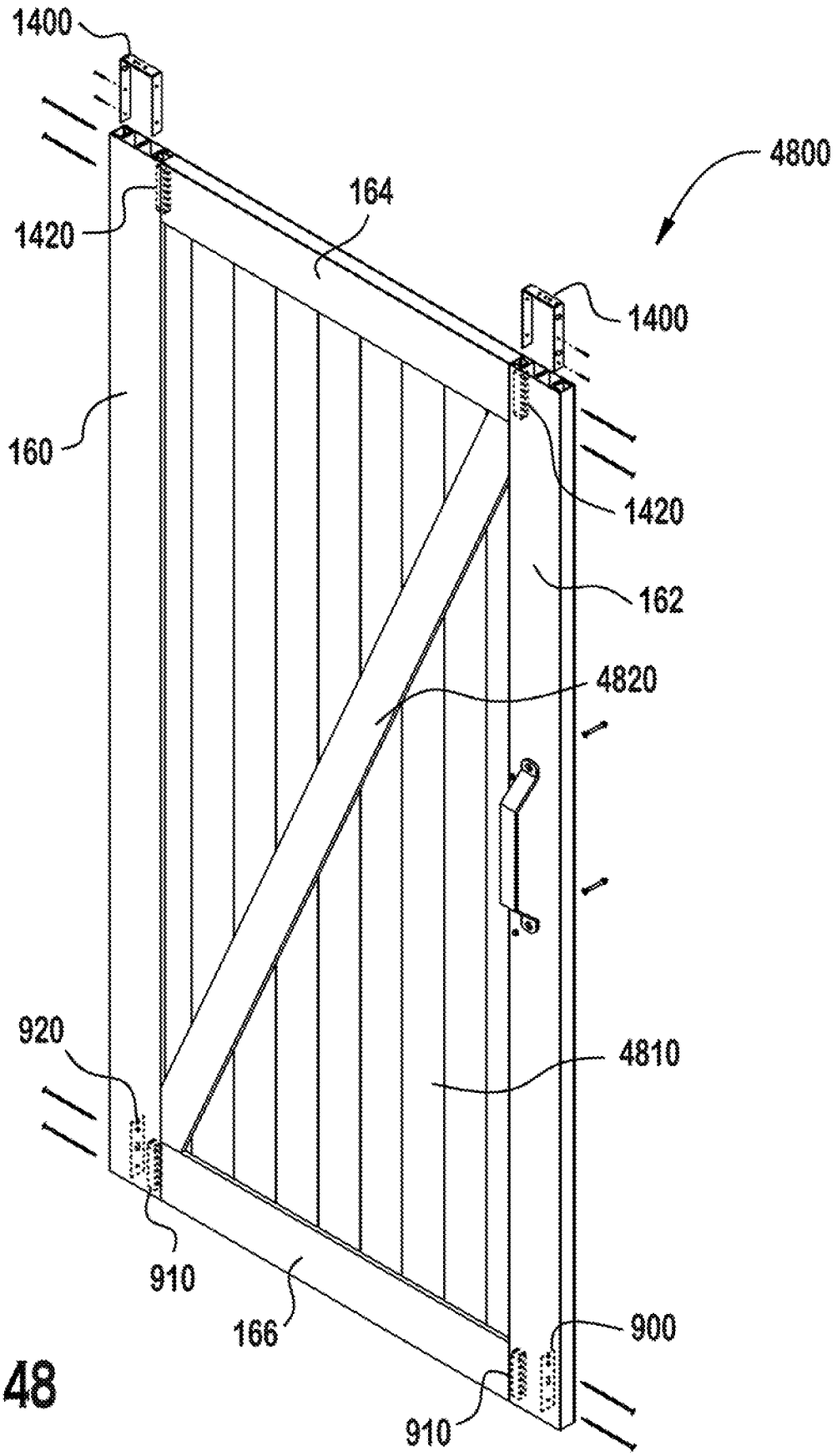
FIG. 48 illustrates a perspective view of an alternative barn door that is part of a barn door kit, according to one embodiment.

FIG. 48 illustrates a perspective view of an alternative barn door 4800 that is part of a barn door kit. The pieces making up the barn door 4800 may include the same frame pieces 160, 162, 164, 166 as the door 130. The frame pieces may be connected in a similar fashion as described above with respect to the door 130 including the use of the brackets 900, support piece 910, brackets 1400 and support pieces 1420. The door 4800 may include a plurality of longer vertical panels 4810 inserted between the upper frame piece 164 and the lower frame piece 166 in similar fashion to the vertical panels 180, 185 of door 130. A cross support 4820 may then be installed diagonally for additional support.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

The description above and the accompanying drawings may reference and depict specific and relative dimensions and configurations of the invention, as well as referencing specific constituent materials and uses for the invention. The invention, however, is not limited to those dimensions, materials, or uses. The dimension and configuration choices made in the description and the accompanying drawings were merely descriptive and do not serve to limit the invention to those dimensions. Although the invention has been illustrated by reference to specific embodiments, it will be apparent that the disclosure is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

What is claimed is:

1. A sliding barn door kit comprising:

a first pair of frame pieces having a channel traversing a first side thereof, wherein the first pair of frame pieces are configured to act as a left side frame and a right side frame of an assembled sliding barn door;

a second pair of frame pieces having a channel traversing a first side thereof, wherein the second pair of frame pieces are configured to act as an upper frame and a lower frame of the assembled sliding barn door, wherein the upper frame, the right side frame, the lower frame and the left side frame make up a perimeter of the assembled sliding barn door, and wherein the channels of the upper frame, the right side frame, the lower frame and the left side frame face inwards;

a plurality of vertical panels, wherein the plurality of vertical panels are individually extruded pieces, wherein the plurality of vertical panels have a tongue traversing a first side and a groove traversing a second side, wherein the plurality of vertical panels are configured to be aligned in at least one row within the perimeter of the assembled sliding barn door, wherein adjacent vertical panels are secured together by securing a tongue of a first panel into a groove in a second panel, wherein the channel of the right side frame is to receive a right most vertical panel, the channel of the upper frame is to receive upper edges of one of the at least one row of the plurality of vertical panels, the channel of the lower frame is to receive lower edges of one of the at least one row of the plurality of vertical panels, and the channel of the left side frame is to receive a left most vertical panel;

a pair of roller brackets to be mounted to the right side frame and the left side frame;

a pair of hardware supports to enable mounting of the pair of roller brackets to the right side frame and the left side frame, wherein the pair of hardware supports are configured to be received in an upper edge of the right side frame and the left side frame; and a track to be secured to a wall and to receive the pair of roller brackets in order to enable the assembled sliding barn door to be slide along the track.

2. The sliding barn door kit of claim 1, wherein the first pair of frame pieces, the second pair of frame pieces and the plurality of vertical panels are made from polyvinyl chloride.

3. The sliding barn door kit of claim 1, wherein the first pair of frame pieces include holes traversing from a second side to the first side along an upper edge and a lower edge;

the second pair of frame pieces include screw taps formed in an upper edge and a lower edge;

the right side frame is secured to the upper frame by passing screws through the holes in the right side frame into the screw taps in the upper frame;

the right side frame is secured to the lower frame by passing screws through the holes in the right side frame into the screw taps in the lower frame;

the left side frame is secured to the upper frame by passing screws through the holes in the left side frame into the screw taps in the upper frame; and the left side frame is secured to the lower frame by passing screws through the holes in the left side frame into the screw taps in the lower frame.

4. The sliding barn door kit of claim 3, further comprising a plurality of support pieces to provide support for connecting frame pieces together, wherein a first support piece is located in an upper edge of the channel of the right side frame and the screws pass through the holes in the right side frame and the first support piece and into the screw taps in the upper frame;

a second support piece is located in a lower edge of the channel of the right side frame and the screws pass through the holes in the right side frame and the second support piece and into the screw taps in the lower frame;

a third support piece is located in an upper edge of the channel of the left side frame and the screws pass through the holes in the left side frame and the third support piece and into the screw taps in the upper frame; and a fourth support piece is located in a lower edge of the channel of the left side frame and the screws pass through the holes in the left side frame and the fourth support piece and into the screw taps in the lower frame.

5. The sliding barn door kit of claim 1, wherein the first pair of frame pieces include screw taps formed in an upper edge and a lower edge, and wherein the pair of hardware supports are secured to the upper edge of the right side frame and the upper edge of the left side frame by threading screws into the screw taps.

6. The sliding barn door kit of claim 1, wherein the pair of hardware supports include threaded nuts to enable the pair of roller brackets to be secured thereto with screws.

7. The sliding barn door kit of claim 1, further comprising safety spacers mounted to an upper edge of the upper frame to prevent the assembled sliding barn door from coming off the track.

8. The sliding barn door kit of claim 7, wherein the safety spacers are configured to rotate between a position above the assembled sliding barn door so as to engage with the track and a position offset from the assembled sliding barn door so as to not engage with the track.

9. The sliding barn door kit of claim 1, further comprising door stops mounted on ends of the track to prevent the assembled sliding barn door from sliding off the track.

10. The sliding barn door kit of claim 1, further comprising a center frame piece mounted between the left side frame and the right side frame, wherein a first row of vertical panels are located between the upper frame and the center frame piece and a second row of vertical panels is located between the center frame piece and the lower frame.

11. A sliding barn door kit comprising:

a plurality of frame pieces to form a frame for an assembled sliding barn door, wherein the frame pieces have front and back faces separated by a plurality of supports, wherein at least a subset of the supports have screw taps formed therein, wherein at least one side of the frame pieces include channels traversing a length thereof, wherein a first pair of the frame pieces are a first length and are configured to act as a left side frame and a right side frame of an assembled sliding barn door, wherein a second pair of frame pieces are a second length and are configured to act as an upper frame and a lower frame of the assembled sliding barn door, and wherein the assembled sliding bar door includes a receiving channel formed along an interior of an external frame formed by the channels in the upper frame, the right side frame, the lower frame and the left side frame;

a plurality of vertical panels, wherein the plurality of vertical panels are individually extruded pieces, wherein the plurality of vertical panels have a tongue traversing a first side and a groove traversing a second side so as to be secured to one another, wherein the plurality of vertical panels are configured to be aligned in at least one row within the external frame and be supported by the receiving channel formed along the interior of the external frame;

a pair of hardware supports mounted to an upper edge of the right side frame and an upper edge of the left side frame by securing screws into the screw taps of the right side frame and the left side frame;

a pair of roller brackets mounted to pair of hardware supports; and a track to be secured to a wall and to receive the pair of roller brackets in order to enable the assembled sliding barn door to be slide along the track.

12. The sliding barn door kit of claim 11, wherein the plurality of frame pieces and the plurality of vertical panels are made from polyvinyl chloride.

13. The sliding barn door kit of claim 11, wherein the right side frame is secured to the upper frame by securing screws into the screw taps in the upper frame;

the right side frame is secured to the lower frame by securing screws into the screw taps in the lower frame;

the left side frame is secured to the upper frame by securing screws into the screw taps in the upper frame; and the left side frame is secured to the lower frame by securing screws into the screw taps in the lower frame.

14. The sliding barn door kit of claim 11, wherein the pair of hardware supports include threaded nuts to enable the pair of roller brackets to be secured thereto with screws.

15. The sliding barn door kit of claim 11, further comprising safety spacers mounted to an upper edge of the upper frame to prevent the assembled sliding barn door from coming off the track, wherein the safety spacers are configured to rotate between a position above the assembled sliding barn door so as to engage with the track and a position offset from the assembled sliding barn door so as to not engage with the track.

16. The sliding barn door kit of claim 11, further comprising door stops mounted on ends of the track to prevent the assembled sliding barn door from sliding off the track.

17. The sliding barn door kit of claim 11, further comprising a center frame piece mounted between the left side frame and the right side frame, wherein a first row of vertical panels are located between the upper frame and the center frame piece and a second row of vertical panels is located between the center frame piece and the lower frame.

18. A sliding barn door kit comprising:

a first pair of polyvinyl chloride (PVC) frame pieces having a first length and front and back faces separated by a plurality of supports, wherein at least a subset of the supports have screw taps formed therein, wherein at least one side of the first pair of frame pieces include a channel traversing the length thereof, and wherein the first pair of frame pieces are configured to act as a left side frame and a right side frame of an assembled sliding barn door;

a second pair of PVC frame pieces having a second length and front and back faces separated by a plurality of supports, wherein at least a subset of the supports have screw taps formed therein, wherein at least one side of the second pair of frame pieces include a channel traversing the length thereof, wherein the second pair of frame pieces are configured to act as a top frame and a bottom frame of an assembled sliding barn door, wherein the first pair of frame pieces are secured to the second pair of frame pieces by securing screws through the first pair of frame pieces into the screw taps in the second pair of frame pieces, and wherein the assembled sliding bar door includes a receiving channel formed along an interior of an external frame formed by the channels in the upper frame, the right side frame, the lower frame and the left side frame;

a plurality of extruded PVC vertical panels, wherein the plurality of vertical panels have front and back faces separated by a plurality of supports a tongue formed along a first side and a groove formed along a second side, wherein the tongue and the groove enable adjacent panels to be secured to one another, wherein the plurality of vertical panels are configured to be aligned in at least one row within the external frame and be supported by the receiving channel formed along the interior of the external frame;

a pair of hardware supports mounted to an upper edge of the right side frame and an upper edge of the left side frame by securing screws through the hardware supports and into the screw taps of the right side frame and the left side frame, wherein the pair of hardware supports include threaded nuts;

a pair of roller brackets mounted to pair of hardware supports by securing screws through the roller brackets into the threaded nuts; and a track to be secured to a wall and to receive the pair of roller brackets in order to enable the assembled sliding barn door to be slide along the track.

19. The sliding barn door kit of claim 18, further comprising safety spacers mounted to an upper edge of the upper frame to prevent the assembled sliding barn door from coming off the track, wherein the safety spacers are configured to rotate between a position above the assembled sliding barn door so as to engage with the track and a position offset from the assembled sliding barn door so as to not engage with the track.

20. The sliding barn door kit of claim 18, further comprising a center frame piece mounted between the left side frame and the right side frame, wherein a first row of vertical panels are located between the upper frame and the center frame piece and a second row of vertical panels is located between the center frame piece and the lower frame.

* * * * *